US010907556B2

(12) United States Patent
Kato et al.

(10) Patent No.: US 10,907,556 B2
(45) Date of Patent: Feb. 2, 2021

(54) EVAPORATED FUEL PROCESSING DEVICE

(71) Applicant: AISAN KOGYO KABUSHIKI KAISHA, Obu (JP)

(72) Inventors: Nobuhiro Kato, Tokai (JP); Daisaku Asanuma, Gamagori (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 154 days.

(21) Appl. No.: 16/089,631

(22) PCT Filed: Mar. 3, 2017

(86) PCT No.: PCT/JP2017/008602
§ 371 (c)(1),
(2) Date: Sep. 28, 2018

(87) PCT Pub. No.: WO2017/169518
PCT Pub. Date: Oct. 5, 2017

(65) Prior Publication Data

US 2020/0208580 A1 Jul. 2, 2020

(30) Foreign Application Priority Data

Mar. 30, 2016 (JP) ..... 2016-069334

(51) Int. Cl.
*F02D 41/00* (2006.01)
*F02M 25/08* (2006.01)
*F02M 35/10* (2006.01)

(52) U.S. Cl.
CPC ..... *F02D 41/004* (2013.01); *F02D 41/0042* (2013.01); *F02D 41/0045* (2013.01);
(Continued)

(58) Field of Classification Search
CPC ..... F02D 41/004; F02D 41/0042; F02D 41/0045; F02M 25/0872; F02M 25/0854; F02M 35/10222; F02M 25/0836
See application file for complete search history.

(56) References Cited

U.S. PATENT DOCUMENTS 6,240,908 B1 6/2001 Hyodo et al.
7,341,048 B2 3/2008 Koyama et al.
(Continued)

FOREIGN PATENT DOCUMENTS

JP 2000080964 A 3/2000
JP 2006348813 A 12/2006
(Continued)

OTHER PUBLICATIONS

International Search Report for PCT/JP2017/008602 dated Apr. 12, 2017 (5 pgs. including English Translation).
(Continued)

*Primary Examiner* — Joseph J Dallo
(74) *Attorney, Agent, or Firm* — Shumaker, Loop & Kendrick, LLP

(57) ABSTRACT

An evaporated fuel processing device may be provided with a canister configured to adsorb evaporated fuel evaporated in a fuel tank; a purge passage through which purge gas sent from the canister to the engine passes; a pump configured to send the purge gas from the canister to the intake passage; a control valve configured to switch between a communication state communicating the canister and the intake passage and a cutoff state cutting off the canister from the intake passage; a branch passage including one end connected to the purge passage on a downstream side relative to the pump and other end connected on an upstream side relative to the pump; and a concentration detector provided on the branch passage.

19 Claims, 21 Drawing Sheets

(52) U.S. Cl.
CPC .... *F02M 25/0836* (2013.01); *F02M 25/0854* (2013.01); *F02M 25/0872* (2013.01); *F02M 35/10222* (2013.01)

(56) References Cited

U.S. PATENT DOCUMENTS

| | | | | |
|---|---|---|---|---|
| 7,409,947 | B2 | 8/2008 | Koyama | |
| 7,418,953 | B2 | 9/2008 | Annoura | |
| 9,759,143 | B2 | 9/2017 | Ooiwa | |
| 2006/0144373 | A1* | 7/2006 | Kano | F02D 41/0045 123/519 |
| 2006/0225713 | A1* | 10/2006 | Kano | F02D 41/0045 123/520 |
| 2007/0186915 | A1* | 8/2007 | Annoura | F02D 41/0042 123/698 |
| 2007/0199372 | A1* | 8/2007 | Annoura | F02M 25/089 73/114.39 |
| 2007/0295313 | A1* | 12/2007 | Annano; Noriyasu | F02M 25/0836 123/520 |
| 2008/0092858 | A1* | 4/2008 | Satoh | F02M 25/0809 123/520 |
| 2009/0070001 | A1* | 3/2009 | Takakura | F02D 41/0032 701/102 |
| 2010/0223984 | A1 | 9/2010 | Pursifull et al. | |

FOREIGN PATENT DOCUMENTS

| | | | |
|---|---|---|---|
| JP | 2007170221 | A | 7/2007 |
| JP | 2007198267 | A | 8/2007 |
| JP | 2007218148 | A | 8/2007 |
| JP | 2015-094329 | A | 5/2015 |
| JP | 2015-229925 | A | 12/2015 |

OTHER PUBLICATIONS

International Preliminary Report on Patentability Examination Report (IPER) for PCT/JP2017/008602 dated Oct. 31, 2017 (17 pgs. including English Translation).

English Translation of JP Office Action for JP App. No. 2016-069334 dated Aug. 13, 2019 (12 pages).

* cited by examiner

EVAPORATED FUEL PROCESSING DEVICE

TECHNICAL FIELD

The description herein discloses a technique related to an evaporated fuel processing device. Especially, an evaporated fuel processing device configured to process evaporated fuel generated in a fuel tank by purging the same to an intake passage of an engine is disclosed.

BACKGROUND ART

JP 2006-348813 (hereinbelow termed Patent Literature 1) describes an evaporated fuel processing device. The evaporated fuel processing device of Patent Literature 1 connects an intake passage of an engine and a canister by a purge passage, and introduces purge gas to the intake passage through the purge passage. Further, Patent Literature 1 provides a concentration detecting passage having one end connected to the purge passage and other end connected to the canister to detect a concentration of the purge gas. A pump for introducing the purge gas from the purge passage is provided on the concentration detecting passage.

SUMMARY OF INVENTION

Technical Problem

Patent Literature 1 introduces purge gas to the intake passage using a phenomenon in which the intake passage has a negative pressure during when the engine is running. Due to this, the purge gas cannot be introduced to the intake passage, for example, in a state where the engine is stopped, which is a state where the intake passage has a positive pressure. As a result, an introduced quantity of the purge gas is limited. The purge gas can be introduced to the intake passage even in the state where the intake passage does not have the negative pressure, if the other end of the concentration detecting passage of Patent Literature 1 is connected to the intake passage. However, a concentration sensor provided in the concentration detecting passage becomes a resistance, and a flowing resistance of the purge gas increases. As a result, the introduced quantity of the purge gas is limited. The description herein provides a technique for realizing an evaporated fuel processing device in which an introduced quantity of purge gas is less likely to be limited.

Solution to Technical Problem

An evaporated fuel processing device disclosed herein may comprise a canister, a purge passage, a pump, a control valve, a branch passage, and a concentration detector. The canister may be configured to adsorb evaporated fuel evaporated in a fuel tank. The purge passage may be connected between the canister and an intake passage of an engine of a vehicle. Purge gas sent from the canister to the engine passes through the purge passage. The pump may be provided on the purge passage and may be configured to send the purge gas from the canister to the intake passage. The control valve may be configured to switch between a communication state and a cutoff state, wherein the communication state is a state in which the canister and the intake passage communicate with each other via the purge passage, and the cutoff state is a state in which communication between the canister and the intake passage on the purge passage is cut off. The branch passage may include one end connected to the purge passage on a downstream side relative to the pump and other end connected on an upstream side relative to the pump. The concentration detector may be provided on the branch passage.

The above evaporated fuel processing device has the pump provided on the passage (the purge passage) connected between the intake passage and the canister. Due to this, the purge gas can be introduced to the intake passage regardless of a pressure state (positive pressure, negative pressure, or normal pressure) in the intake passage. For example, in a vehicle provided with a supercharger, the purge gas can be introduced to the intake passage even when the intake passage is at the positive pressure. Further, since the concentration detector is provided on the branch passage which branches from the purge passage, flow of the purge gas in the purge passage can be prevented from being hindered while the purge gas pass through the purge passage. According to these characteristics, in the above evaporated fuel processing device, introduced quantity of the purge gas to the intake passage is less likely to be limited. The above evaporated fuel processing device includes the control valve. When the control valve switches to the cutoff state (prohibiting the purge gas to flow to the intake passage) in a state where the pump is driven, the purge gas flows to the branch passage and a concentration of the purge gas can be detected by the concentration detector. The above "control valve" may be a type of valve which switches only between the communication state and the cutoff state, or may be a type of valve configured to adjust its aperture. As the former type of valve, for example, a control valve which adjusts a flow rate of the purge gas during a purge by controlling the communication state and the cutoff state by duty control may be exemplified. As the latter type of valve, for example, a control valve of a stepping motor-type may be exemplified. By adjusting the aperture of the control valve of the stepping motor-type, the flow rate of the purge gas during a purge can be adjusted.

DETAILED DESCRIPTION OF EMBODIMENTS

Figure 1:
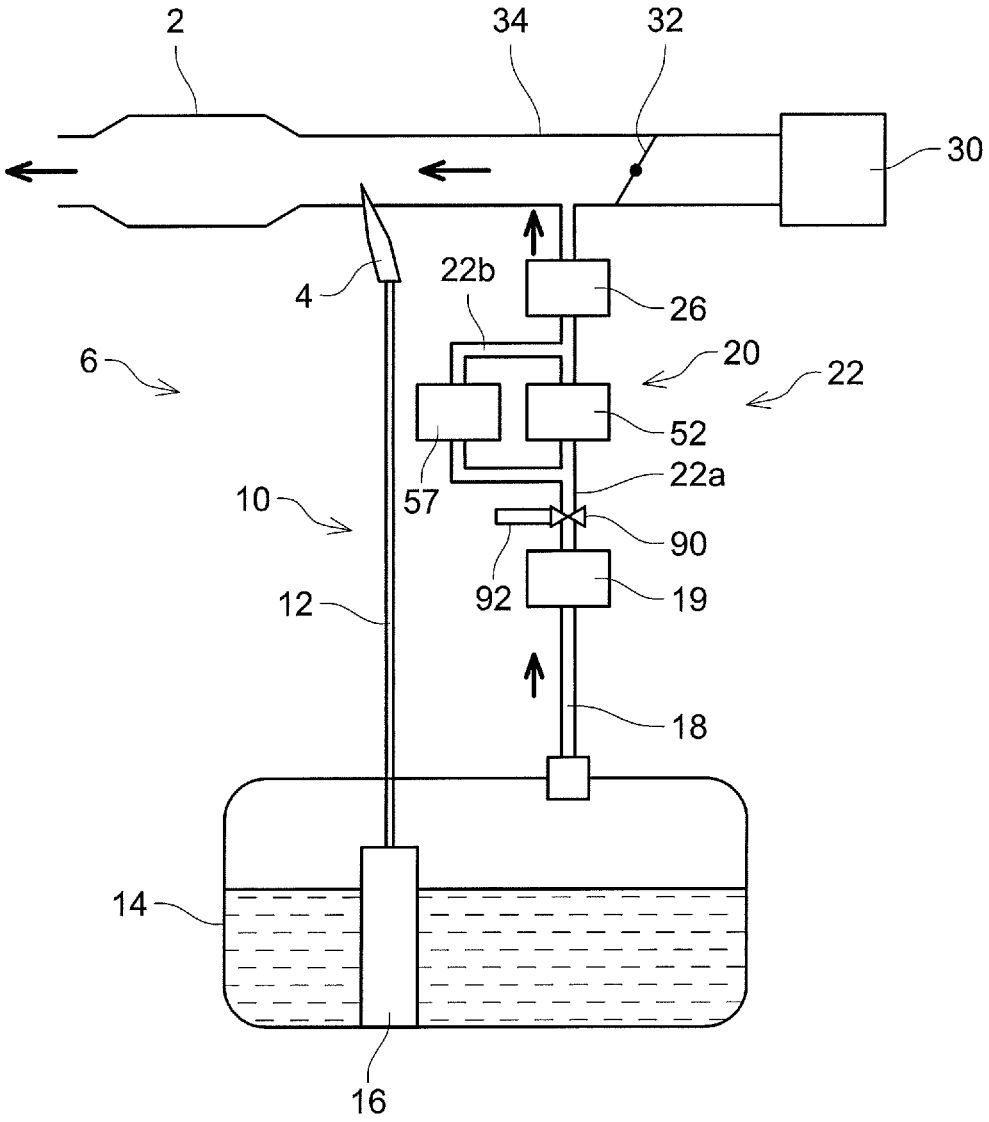
FIG. 1 shows a fuel supply system of a vehicle using an evaporated fuel processing device of a first embodiment.

Primary features of embodiments described below will be listed. It should be noted that the respective technical elements described below are independent of one another, and are useful solely or in combinations.

(Feature 1) In an evaporated fuel processing device disclosed herein, a branch passage may be connected to a purge passage, and a concentration detector configured to detect a concentration of purge gas may be provided on a passage of the branch passage. One end of the branch passage may be connected to the purge passage on a downstream side relative to a pump provided on the purge passage. Other end of the branch passage may be connected to various positions so long as it is connected on an upstream side relative to the pump. For example, the other end of the branch passage may be connected to the purge passage on the upstream side relative to the pump. Further, the other end of the branch passage may be connected to a communication pipe that connects a fuel tank and a canister. Alternatively, the other end of the branch passage may be connected to the canister. Regardless of to whichever position described above the other end of the branch passage is connected, the purge gas flows to the branch passage when a control valve is in a cutoff state, and the concentration of the purge gas can be detected by the concentration detector.

(Feature 2) In a case where the other end of the branch passage is connected to the communication pipe that connects the fuel tank and the canister or to the canister, a member that is configured to allow the purge gas to flow from the purge passage to the canister and prohibit the purge gas from flowing from the canister to the purge passage may be provided at the other end of the branch passage. For example, as a member that serves the aforementioned function, a check valve may be exemplified. With such a member, the evaporated fuel generated in the fuel tank can be prevented from being introduced to an intake passage of an engine directly through the branch passage.

(Feature 3) A switching device may be provided on the purge passage, and the switching device may be configured to switch between a first state in which the purge passage communicates with the canister and a second state in which the purge passage communicates with open air. By setting the switching device in the first state, the purge gas from the canister can be introduced to the purge passage. By setting the switching device in the second state, open air can be introduced to the purge passage. By switching gas to be introduced into the purge passage between the purge gas and the open air, a flow rate characteristic of the pump can be obtained.

(Feature 4) The evaporated fuel processing device may further comprise a controller configured to control operations of the control valve and the pump. In this case, the controller may be configured, after a startup operation of the vehicle is performed, to set the control valve to a communication state to scavenge the purge passage, set the control valve to a cutoff state and perform control of detecting a concentration of the purge gas after the scavenging. Here, "scavenging the purge passage" means to discharge the purge gas that was remaining in the purge passage prior to the startup operation from the purge passage to the intake passage. When the startup operation of the vehicle is performed, there are cases where the purge gas remains since the vehicle last stopped. If gas concentration measurement is performed in such a state, an accurate concentration of the current purge gas cannot be detected. By scavenging the purge passage prior to measuring the concentration of the purge gas, the accurate concentration of the purge gas can be detected. The scavenging of the purge passage may be performed by driving the pump, or may be performed by suction force of an intake pipe without driving the pump. Further, the concentration detection of the purge gas may be performed when a predetermined time has elapsed after the control valve was set to the cutoff state. Alternatively, the concentration detection of the purge gas may be performed in a state where the concentration of the purge gas has stabilized after the control valve was set to the cutoff state. In either case, a more accurate gas concentration can be detected.

(Feature 5) The controller may be configured, after the startup operation of the vehicle is performed, to set the control valve to the cutoff state and perform control of detecting the concentration of the purge gas, then when purging based on the detected concentration has been performed and stopped, the controller may be configured to perform control of detecting the concentration of the purge gas again with the control valve being in the cutoff state and the pump being driven. That is, a first gas concentration may be detected by performing the purge gas concentration measurement for a first time after the startup operation of the vehicle was performed; when purging is to be performed thereafter, the purging may be performed based on the first gas concentration; when the purging is stopped based on the first gas concentration, a second gas concentration may be detected by performing the purge gas concentration measurement for a second time; and when the purging is to be performed thereafter, the purging may be performed based on the second gas concentration. After this, the gas concertation may be detected each time the purging is stopped, and the purging may be performed based on the detected gas concentration. The controller may compare the purge gas concentration measurement of the second or subsequent time with an initial one (the purge gas concentration measurement for the first time, which was performed after the startup operation of the vehicle), and may perform the purging at an earlier timing since the control valve is set in the cutoff state. In a case where a feedback deviation from an A/F sensor during purging exceeds a predetermined value, the controller may perform control to detect the purge gas concentration in the state where the control valve is in the cutoff state with the pump being driven, even if this is not a timing at which the purging is supposed to be stopped.

EMBODIMENTS

First Embodiment

A fuel supply system 6 provided with an evaporated fuel processing device 20 will be described with reference to FIG. 1. The fuel supply system 6 includes a main supply passage 10 for supplying fuel stored in a fuel tank 14 to an engine 2 and a purge supply passage 22 for supplying evaporated fuel generated in the fuel tank 14 to the engine 2.

The main supply passage 10 is provided with a fuel pump unit 16, a supply pipe 12, and an injector 4. The fuel pump unit 16 includes a fuel pump, a pressure regulator, a control circuit, and the like. The fuel pump unit 16 controls the fuel pump according to a signal supplied from an ECU (not shown). The fuel pump boosts the fuel in the fuel tank 14 and discharges the same. The fuel discharged from the fuel pump is pressure-regulated by the pressure regulator and is supplied from the fuel pump unit 16 to the supply pipe 12. The supply pipe 12 is connected to the fuel pump unit 16 and the injector 4. The fuel supplied to the supply pipe 12 passes through the supply pipe 12 and reaches the injector 4. The injector 4 includes a valve (not shown) of which aperture is controlled by the ECU. When the valve of the injector 4 is opened, the fuel in the supply pipe 12 is supplied to an intake pipe 34 connected to the engine 2.

The intake pipe 34 is connected to an air cleaner 30. The air cleaner 30 includes a filter for removing foreign matters in air flowing into the intake pipe 34. A throttle valve 32 is provided in the intake pipe 34. When the throttle valve 32 opens, suction is performed from the air cleaner 30 toward the engine 2. The throttle valve 32 adjusts an aperture of the intake pipe 34 and thereby adjusts a quantity of air flowing into the engine 2. The throttle valve 32 is provided on an upstream side (air cleaner 30 side) than the injector 4.

The purge supply passage 22 includes a purge passage 22*a* through which purge gas passes from a canister 19 to the intake pipe 34 and a branch passage 22*b* that branches from the purge passage 22*a*. The evaporated fuel processing device 20 is provided on the purge supply passage 22. The evaporated fuel processing device 20 includes the canister 19, the purge passage 22*a*, a pump 52, a control valve 26, the branch passage 22*b*, a concentration sensor 57, a switch valve 90, and an air introducing pipe 92. The fuel tank 14 and the canister 19 are connected by a communication pipe 18. The canister 19, the switch valve 90, the pump 52, and the control valve 26 are provided on the purge passage 22*a*. The purge passage 22*a* is connected to the intake pipe 34 between the injector 4 and the throttle valve 32. The branch passage 22*b* has one end thereof connected to the purge passage 22*a* on an upstream side relative to the pump 52 and other end thereof connected to the purge passage 22*a* on a downstream side relative to the pump 52. The concentration sensor 57 is provided on the branch passage 22*b*. The control valve 26 is a solenoid valve controlled by the ECU, and is a valve of which switching between a communication state and a cutoff state is duty-controlled by the ECU. The control valve 26 adjusts a flow rate of the evaporated fuel (purge gas) by controlling its opening and closing periods (controlling a switching timing between the communication state and the cutoff state). Further, a valve capable of adjusting its aperture, such as a stepping motor-type control valve, may be used instead of the control valve 26.

Figure 2:
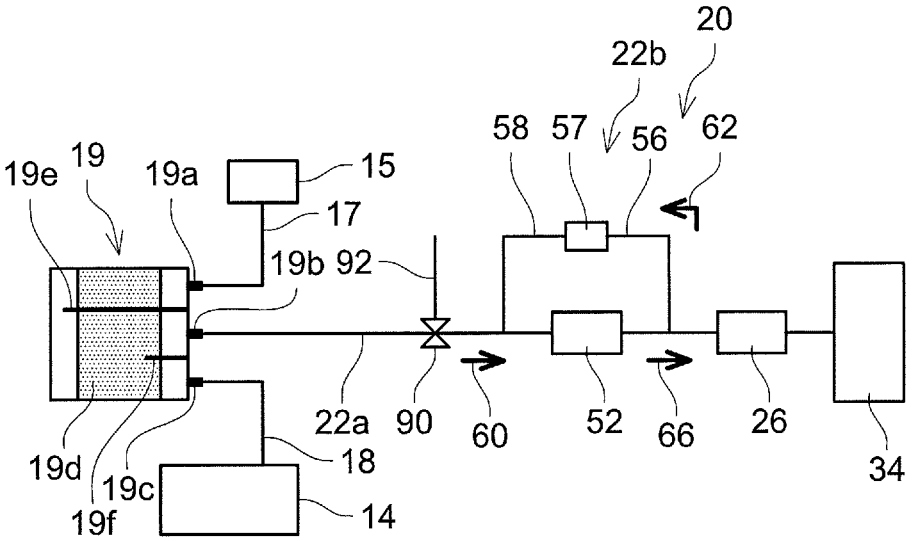
FIG. 2 shows the evaporated fuel processing device of the first embodiment.

As shown in FIG. 2, the canister 19 is provided with an air port 19*a*, a purge port 19*b*, and a tank port 19*c*. The air port 19*a* is connected to an air filter 15 via a communication pipe 17. The purge port 19*b* is connected to the purge passage 22*a*. The tank port 19*c* is connected to the fuel tank 14 via the communication pipe 18. Activated charcoal 19*d* is accommodated in the canister 19. The ports 19*a*, 19*b*, and 19*c* are provided on one of wall surfaces of the canister 19 that face the activated charcoal 19*d*. A space exists between the activated charcoal 19*d* and an inner wall of the canister 19 on which the ports 19*a*, 19*b*, and 19*c* are provided. A first partitioning plate 19*e* and a second partitioning plate 19*f* are fixed to the inner wall of the canister 19 on which the ports 19*a*, 19*b*, and 19*c* are provided. The first partitioning plate 19*e* partitions the space between the activated charcoal 19*d* and the inner wall of the canister 19 in a range between the air port 19*a* and the purge port 19*b*. The first partitioning plate 19*e* extends to a space on an opposite side to the side where the ports 19*a*, 19*b*, and 19*c* are provided. The second partitioning plate 19*f* partitions the space between the activated charcoal 19*d* and the inner wall of the canister 19 in a range between the purge port 19*b* and the tank port 19*c*.

The activated charcoal 19*d* adsorbs the evaporated fuel from gas that flows into the canister 19 from the fuel tank 14 through the communication pipe 18 and the tank port 19*c*. The gas from which the evaporated fuel has been adsorbed passes through the air port 19*a*, the communication pipe 17 and the air filter 15, and is discharged to open air. The canister 19 can prevent the evaporated fuel in the fuel tank 14 from being discharged to open air. The evaporated fuel adsorbed in the activated charcoal 19*d* is supplied to the purge passage 22*a* from the purge port 19*b*. The first partitioning plate 19*e* partitions between the space where the air port 19*a* is connected and the space where the purge port 19*b* is connected. The first partitioning plate 19*e* prevents the gas containing the evaporated fuel from being discharged to open air. The second partitioning plate 19*f* partitions between the space where the purge port 19*b* is connected and the space where the tank port 19*c* is connected. The second partitioning plate 19*f* prevents the gas flowing into the canister 19 from the tank port 19*c* from directly flowing to the purge passage 22*a*.

The purge passage 22*a* connects the canister 19 and the intake passage 34. The pump 52 and the control valve 26 are provided on the purge passage 22*a*. The pump 52 is provided between the canister 19 and the control valve 26, and pumps the evaporated fuel (purge gas) to the intake passage 34. Specifically, the pump 52 draws the purge gas in the canister 19 through the purge passage 22*a* in a direction of an arrow 60, and pushes the purge gas through the purge passage 22*a* toward the intake passage 34 in a direction of an arrow 66. In a case where the engine 2 is driving, the intake passage 34 is at a negative pressure. Due to this, the evaporated fuel adsorbed in the canister 19 can be introduced to the intake passage 34 by a pressure difference between the intake passage 34 and the canister 19. However, by providing the pump 52 on the purge passage 22*a*, the evaporated fuel adsorbed in the canister 19 can be supplied to the intake passage 34 even in a case where the intake passage 34 is at a pressure that is not sufficient to draw the purge gas therein (in a case of a positive pressure while supercharging, or in a case of a negative pressure having a small absolute value thereof). Further, by providing the pump 52, a desired quantity of the evaporated fuel can be supplied to the intake passage 34.

The purge passage 22*a* has the branch passage 22*b* connected thereto. The concentration sensor 57 is provided on the branch passage 22*b*. More specifically, the branch passage 22*b* is provided with a first branch pipe 56 and a second branch pipe 58. One end of the first branch pipe 56 is connected on the downstream side relative to the pump 52 (on an intake passage 34 side). One end of the second branch pipe 58 is connected on the upstream side relative to the pump 52 (on a canister 19 side). Other ends of the first branch pipe 56 and the second branch pipe 58 are connected to the concentration sensor 57. The concentration sensor 57 detects the concentration of the purge gas passing through the branch passage 22*b*.

In the evaporated fuel processing device 20, when the control valve 26 is opened in the state where the pump 52 is driven, the purge gas flows in the direction of the arrow 66 and is introduced into the intake passage 34. Further, when the control valve 26 is closed in the state where the pump 52 is driven, the purge gas flows in a direction of an arrow 62, and the concentration is detected in the concentration sensor 57. During purging, the control valve 26 is repeatedly opened and closed based on a duty ratio to adjust the supply quantity of the purge gas to the intake pipe 34. The evaporated fuel processing device 20 can detect the concentration of the purge gas by using timings when the control valve 26 is closed during the purging. The concentration sensor 57 is provided on the branch passage 22*b*, but is not provided on the purge passage 22*a*. Due to this, the evaporated fuel processing device 20 can suppress a resistance in the purge passage 22*a* from increasing and can suppress the quantity of the purge gas supplied to the intake passage 34 from being limited. By adjusting inner diameters of the purge passage 22*a* and the branch passage 22*b*, the purge gas can be supplied to the concentration sensor 57 while being supplied to the intake passage 34. In this case, the concentration of the purge gas supplied to the intake passage 34 can be detected on real-time basis.

Further, the switch valve 90 is provided on the purge passage 22*a*. The switch valve 90 is provided on the upstream side relative to the pump 52. The air introducing pipe 92 is connected to the switch valve 90. The switch valve 90 is configured to switch between a state (first state) in which the purge passage 22*a* is connected to the canister 19 and a state (second state) in which the purge passage 22*a* is connected to the air introducing pipe 92. By providing the switch valve 90, in a case where the concentration sensor 57 is of a type of concentration sensor that detects a differential pressure between upstream and downstream of the sensor, a pressure difference between the upstream and downstream sides of the sensor when air passes through the branch passage 22*b* can be compared with a pressure difference therebetween when the purge gas passes through the branch passage 22*b* by switching the switch valve 90. By comparing these pressure differences, a characteristic of the pump 52 (a flow rate of fluid that passes through the pump at a predetermined rotary speed) can be calculated. A flow rate of fluid passing through the pump 52 changes depending on a density (concentration) of the passing fluid, despite an output (rotary speed) of the pump 52 being the same. By providing the switch valve 90 and by comparing the pressure differences in the air and the purge gas passing through a concentration sensor 70, the flow rate characteristic of the pump 52 can be obtained and a detection accuracy for the purge gas concentration improves, by which a more accurate quantity of the purge gas can be introduced to the intake pipe 34. The switch valve 90 and the air introducing pipe 92 contribute to improving the detection accuracy for the purge gas concentration, and the purge gas concentration can still be detected even when the switch valve 90 and the air introducing pipe 92 are omitted.

Figure 3:
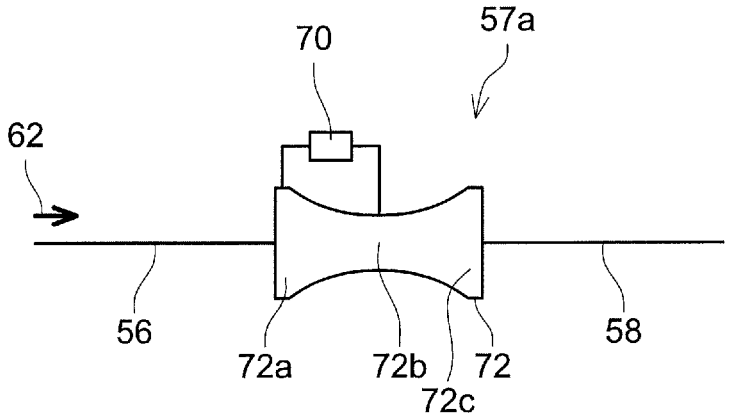
FIG. 3 shows an example of a concentration sensor.

As the concentration sensor 57, various types of sensors may be used. Here, some examples of the concentration sensor 57 that can be used in the evaporated fuel processing device 20 will be described with reference to FIGS. 3 to 6. FIG. 3 shows a concentration sensor 57*a* provided with a venturi tube 72. One end 72*a* of the venturi tube 72 is connected to the first branch pipe 56. The other end 72*c* of the venturi tube 72 is connected to the second branch pipe 58. The differential pressure sensor 70 is connected between the end 72*a* and a center portion (narrowed portion) 72*b* of the venturi tube. The concentration sensor 57*a* detects a pressure difference between the end 72*a* and the center portion 72*b* by the differential pressure sensor 70. By detecting the pressure difference between the end 72*a* and the center portion 72*b*, the density of the purge gas (purge gas concentration) can be calculated by a Bernoulli equation.

Figure 4:
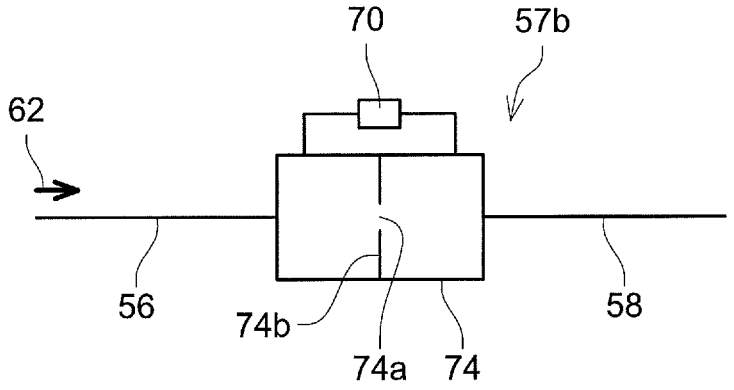
FIG. 4 shows an example of the concentration sensor.

FIG. 4 shows a concentration sensor 57*b* provided with an orifice tube 74. One end of the orifice tube 74 is connected to the first branch pipe 56 and the other end thereof is connected to the second branch pipe 58. An orifice plate 74*b* having a hole 74*a* is provided at a center of the orifice tube 74. The differential pressure sensor 70 is connected on upstream and downstream sides relative to the orifice plate 74*b*. The concentration sensor 57*b* detects a pressure difference between the upstream and downstream sides of the orifice plate 74*b* by the differential pressure sensor 70 and calculates the purge gas concentration.

Figure 5:
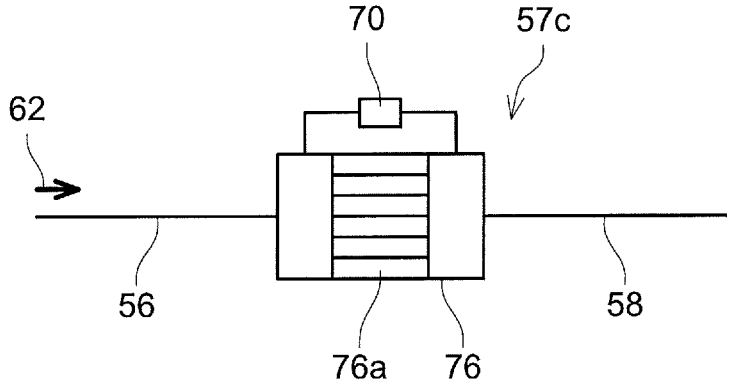
FIG. 5 shows an example of the concentration sensor.

FIG. 5 shows a concentration sensor 57*c* provided with a capillary viscometer 76. One end of the capillary viscometer 76 is connected to the first branch pipe 56, and the other end thereof is connected to the second branch pipe 58. A plurality of capillary tubes 76*a* is provided in the capillary viscometer 76. The differential pressure sensor 70 is connected on upstream and downstream sides relative to the capillary tubes 76*a*. The concentration sensor 57*c* detects a pressure difference between the upstream and downstream sides of the capillary tubes 76*a* by the differential pressure sensor 70 and measures a viscosity of the fluid (purge gas) flowing through the capillary viscometer 76. By detecting the pressure difference between the upstream and downstream sides of the capillary tubes 76*a*, the viscosity of the fluid can be calculated by a Hagen-Poiseuille equation. The viscosity of the purge gas has a correlated relationship with the concentration of the purge gas. Due to this, the concentration of the purge gas can be detected by calculating the viscosity of the purge gas.

Figure 6:
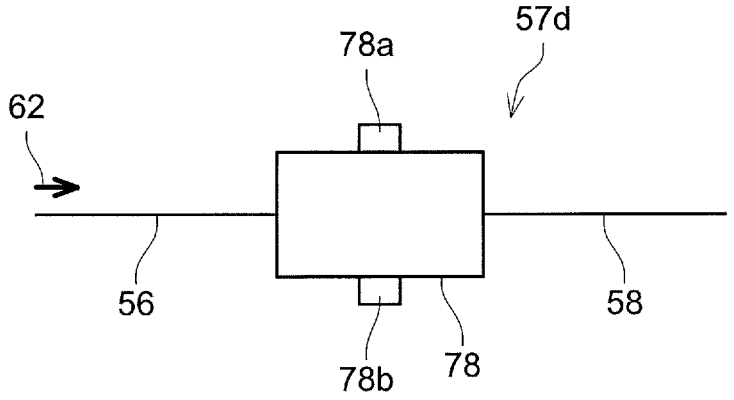
FIG. 6 shows an example of the concentration sensor.

FIG. 6 shows a concentration sensor 57*d* provided with a sonic concentration meter 78. The sonic concentration meter 78 has a cylinder shape. One end of the sonic concentration meter 78 is connected to the first branch pipe 56 and another end thereof is connected to the second branch pipe 58. The sonic concentration meter 78 is provided with a transmitter 78*a* that transmits a signal into the cylinder and a receiver 78*b* that receives the signal transmitted from the transmitter 78*a*. The sonic concentration meter 78 detects a time t which the signal takes to reach the receiver 78*b* from the transmitter 78*a*. A sonic speed v in the cylinder is calculated based on the time t and a distance L between the transmitter 78*a* and the receiver 78*b*. The sonic speed v in the cylinder has a correlated relationship with the concentration of the purge gas passing through the cylinder. Due to this, the concentration of the purge gas (molecular weight of the purge gas) can be detected by measuring the sonic speed v in the cylinder. Specifically, the following formula (1) is known to be satisfied with the sonic speed is v, the molecular weight M of the purge gas, a specific heat ratio γ, a gas constant R, and an absolute temperature T. By using the following formula (1), the purge gas concentration can be detected.

$$v=(\gamma\times R\times T/M)^{0.5} \quad \text{Formula (1):}$$

The four types of the concentration sensors 57 (57*a* to 57*d*) have been described above, however, the evaporated fuel processing device 20 may use other types of concentration sensor. What is important is that one end of the branch passage 22*b* (the first branch passage 56) is connected to the purge passage 22*a* on the downstream side relative to the pump 52, the other end of the branch passage 22*b* (the second branch passage 58) is connected on the upstream side relative to the pipe 52, and the concentration sensor 57 is provided on the branch passage 22*b*. By configuring as such, the purge gas flows to the branch passage 22*b* at least when the control valve 26 is closed, and the purge gas concentration detection can thereby be performed.

Figure 7:
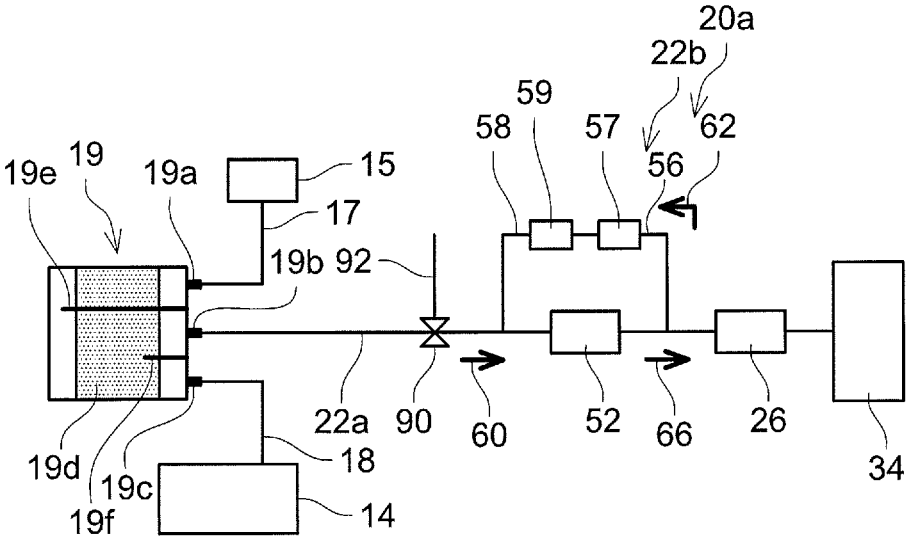
FIG. 7 shows a variant of the evaporated fuel processing device of the first embodiment.
Figure 8:
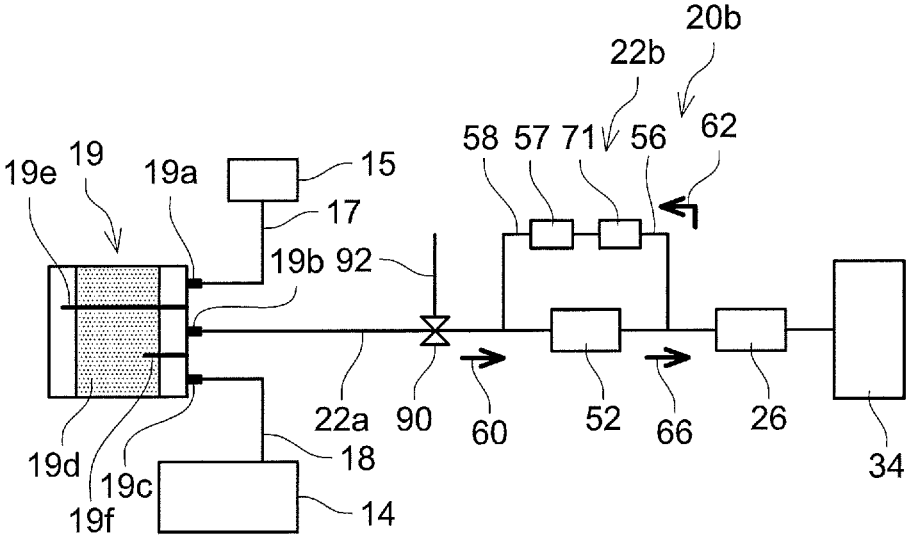
FIG. 8 shows a variant of the evaporated fuel processing device of the first embodiment.

As in an evaporated fuel processing device 20*a* shown in FIG. 7, the concentration sensor 57 and a temperature sensor 59 may be provided on the branch passage 22*b*. Further, as in an evaporated fuel processing device 20*b* shown in FIG. 8, the concentration sensor 57 and a pressure gauge 71 may be provided on the branch passage 22*b*. The pressure gauge 71 is provided on the upstream side relative to the concentration sensor 57. The evaporated fuel processing device 20*b* may further be provided with a temperature sensor on the branch passage 22*b* (see FIG. 7).

Second Embodiment

Figure 9:
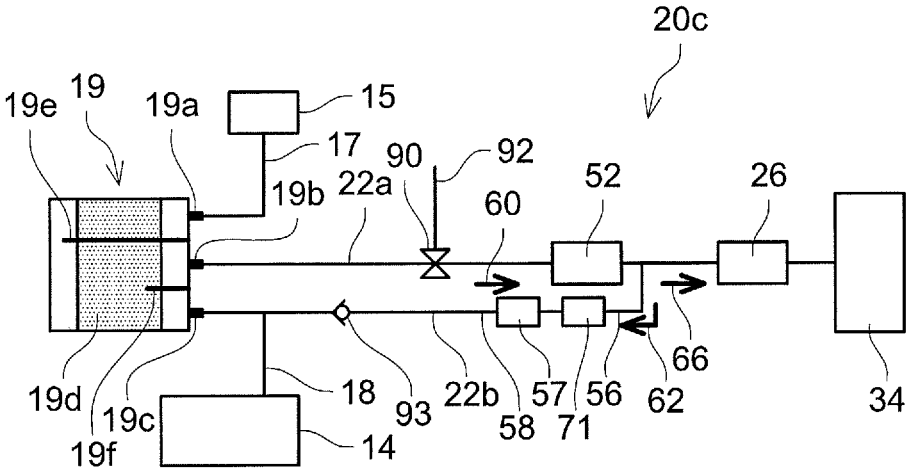
FIG. 9 shows an evaporated fuel processing device of a second embodiment.

An evaporated fuel processing device 20*c* will be described with reference to FIG. 9. The evaporated fuel processing device 20*c* is a variant of the evaporated fuel processing devices 20, 20*a*, and 20*b*. Specifically, the evaporated fuel processing device 20*c* differs from the evaporated fuel processing device 20 in its position where a downstream end of the branch passage 22*b* (purge-gas outlet side of the branch passage) is connected. For the evaporated fuel processing device 20*c*, its components identical to those of the evaporated fuel processing devices 20, 20*a*, and 20*b* will be given the same reference numbers, and description thereof may be omitted. The evaporated fuel processing device 20*c* has the concentration sensor 57 and the pressure gauge 71 provided on the branch passage 22*b* as in the evaporated fuel processing device 20*b*. However, only the concentration sensor 57 may be provided on the branch passage 22*b* as in the evaporated fuel processing device 20, the concentration sensor 57 and the temperature sensor 59 may be provided on the branch passage 22*b* as in the evaporated fuel processing device 20*a*, or the concentration sensor 57, the pressure gauge 71, and the temperature sensor 59 may be provided on the branch passage 22*b*.[0030] In the evaporated fuel processing device 20*c*, the second branch pipe 58 (the branch pipe on the downstream side of the branch passage) is connected to the communication pipe 18. Due to this, the purge gas passing through the branch passage 22*b* flows to the canister 19 through the tank port 19*c*. In the evaporated fuel processing device 20*c* as well, the purge gas passes through the branch passage 22*b* when the control valve 26 is closed, by which the purge gas concentration can be detected. The tank port 19*c* is not provided on the purge passage 22*a*, however, the canister 19 is a component provided on the upstream side relative to the pump 52. Due to this, in the evaporated fuel processing device 20*c* as well, it can be said that one end of the branch passage 22*b* is connected to the purge passage 22*a* on the downstream side relative to the pump 52 and other end thereof is connected on the upstream side relative to the pump 52. A check valve 93 is provided between the branch passage 22*b* and the communication pipe 18. Due to this, the purge gas generated in the fuel tank 14 can be prevented from being introduced to the purge passage 22*a* through the communication pipe 18 and the branch passage 22*b*.

Third Embodiment

Figure 10:
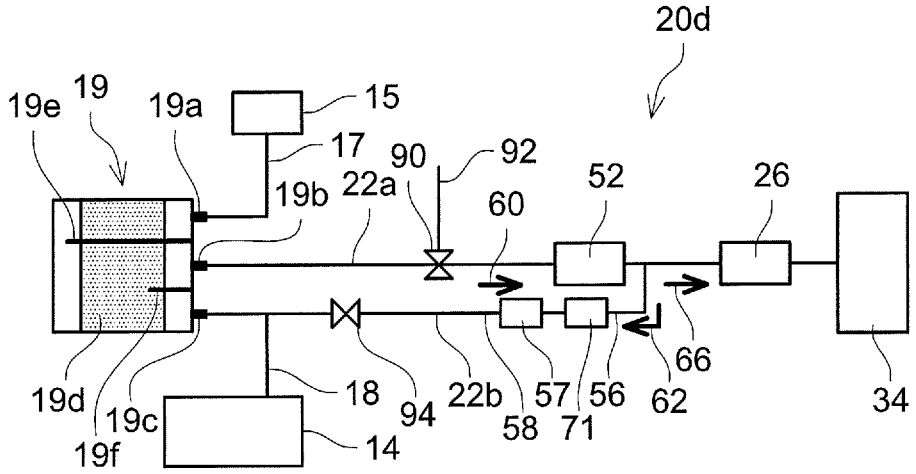
FIG. 10 shows an evaporated fuel processing device of a third embodiment.

An evaporated fuel processing device 20*d* will be described with reference to FIG. 10. The evaporated fuel processing device 20*d* is a variant of the evaporated fuel processing device 20*c*. Specifically, the evaporated fuel processing device 20*d* differs from the evaporated fuel processing device 20*c* in that a switch valve 94 is provided between the branch passage 22*b* and the communication pipe 18. For the evaporated fuel processing device 20*d*, its components identical to those of the evaporated fuel processing device 20*c* will be given the same reference numbers, and description thereof may be omitted. The evaporated fuel processing device 20*d* has the concentration sensor 57 and the pressure gauge 71 provided on the branch passage 22*b*. However, in the evaporated fuel processing device 20*d* as well as in the evaporated fuel processing device 20*c*, only the concentration sensor 57 may be provided on the branch passage 22*b*, the concentration sensor 57 and the temperature sensor 59 may be provided on the branch passage 22*b*, or the concentration sensor 57, the pressure gauge 71, and the temperature sensor 59 may be provided on the branch passage 22*b*.

The switch valve 94 is configured to switch between a communication state in which the branch passage 22*b* and the communication pipe 18 communicate with each other and a cutoff state in which communication between the branch passage 22*b* and the communication pipe 18 is cut off. The evaporated fuel processing device 20*d* can increase a pressure in the branch passage 22*b* by driving the pump 52 in a state where the control valve 26 is closed and the switch valve 94 is closed (in the cutoff state). By configuring as such, the characteristic of the pump 52 can be detected.

Fourth Embodiment

Figure 11:
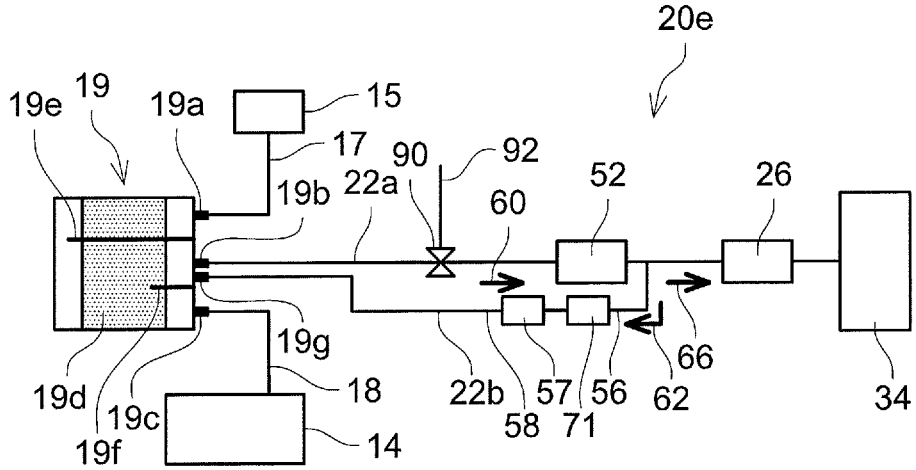
FIG. 11 shows an evaporated fuel processing device of a fourth embodiment.

An evaporated fuel processing device 20*e* will be described with reference to FIG. 11. The evaporated fuel processing device 20*e* is a variant of the evaporated fuel processing devices 20 to 20*d*. Specifically, the evaporated fuel processing device 20*e* differs from the evaporated fuel processing devices 20 to 20*d* in its position where the downstream end of the branch passage 22*b* (the purge-gas outlet side of the branch passage) is connected. For the evaporated fuel processing device 20*e*, its components identical to those of the evaporated fuel processing devices 20 to 20*d* will be given the same reference numbers, and description thereof may be omitted. The evaporated fuel processing device 20*e* has the concentration sensor 57 and the pressure gauge 71 provided on the branch passage 22*b*. However, in the evaporated fuel processing device 20*e* as well as in the evaporated fuel processing devices 20*c* and 20*d*, only the concentration sensor 57 may be provided on the branch passage 22*b*, the concentration sensor 57 and the temperature sensor 59 may be provided on the branch passage 22*b*, or the concentration sensor 57, the pressure gauge 71, and the temperature sensor 59 may be provided on the branch passage 22*b*.

In the evaporated fuel processing device 20*e*, a return port 19*g* is provided on the canister 19. The return port 19*g* is provided on a purge port 19*b* side relative to the second partitioning plate 19*f*. That is, the second partitioning plate 19*f* partitions the space between the activated charcoal 19*d* and the inner wall of the canister 19 in a range between the return port 19*g* and the tank port 19*c*. In case of this configuration, the evaporated fuel generated in the fuel tank 14 can be prevented from being introduced to the purge passage 22*a* through the branch passage 22*b*. Due to this, there is no need to provide a check valve or a switch valve between the branch passage 22*b* and the tank port 19*c* (see also FIGS. 9 and 10).

Figure 12:
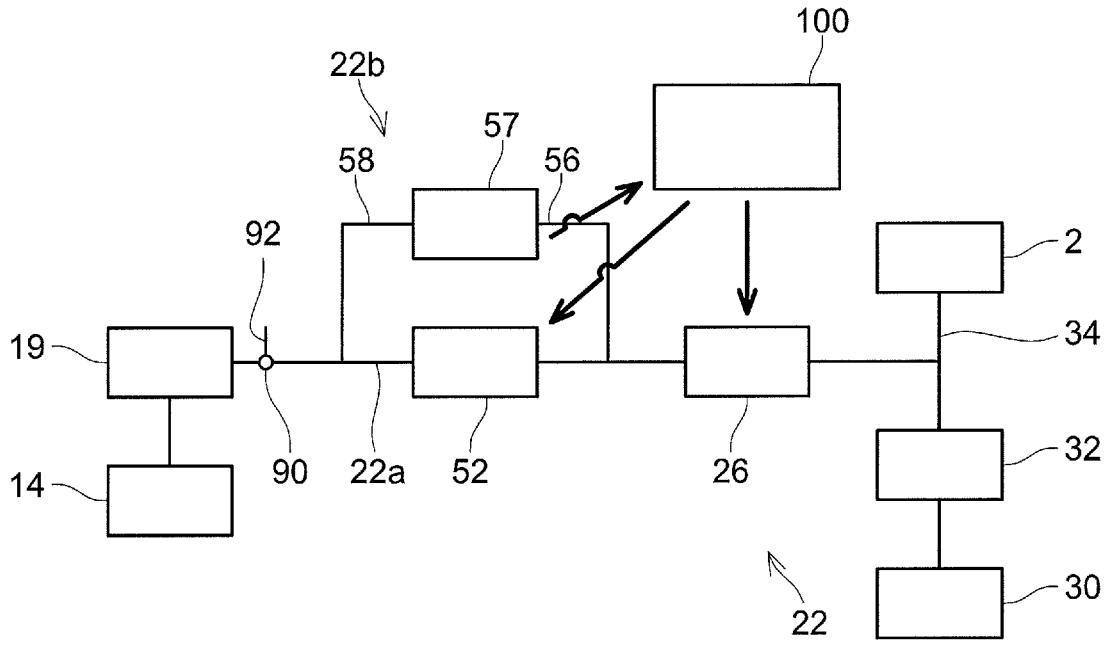
FIG. 12 shows an evaporated fuel supply system.

An operation of the purge supply passage 22 upon supplying the purge gas to the intake pipe 34 will be described with reference to FIG. 12. When the engine 2 starts, the pump 52 starts to drive and the control valve 26 starts its opening and closing operations by control of an ECU 100. The ECU 100 controls an output of the pump 52 and an aperture (or a duty ratio) of the control valve 26 based on the purge gas concentration detected by the concentration sensor 57. The ECU 100 also controls the aperture of the throttle valve 32. The evaporated fuel from the fuel tank 14 is adsorbed in the canister 19. When the pump 52 is started, the purge gas that was adsorbed in the canister 19 and the air having passed through the air cleaner 30 are introduced to the engine 2. Hereinbelow, some methods of detecting the purge gas concentration will be described.

Figure 13:
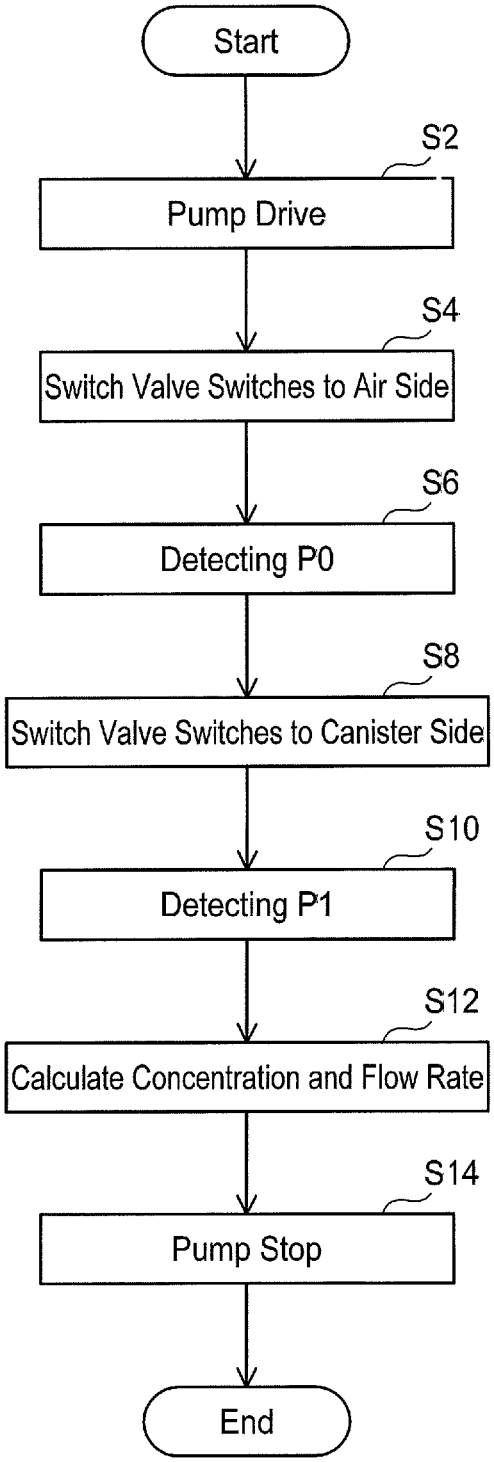
FIG. 13 shows a flowchart of a method of detecting a concentration and a flow rate of purge gas.

FIG. 13 shows a flowchart explaining a method of detecting the purge gas concentration and a purge gas flow rate. This method is performed for calculating the flow rate characteristic of the pump 52 and detecting the flow rate of the purge gas passing through the pump 52 when the pump 52 is at the predetermined rotary speed. This method is performed in a state where the control valve 26 is closed (the purge gas is not introduced to the intake pipe 34). This method may be performed in any of the evaporated fuel processing devices 20, 20*a* to 20*e*. However, it is essential to use a concentration sensor of a type which detects a pressure difference between upstream and downstream sides of the sensor, such as the concentration sensors 57*a*, 57*b*, and 57*c*.

Firstly, the pump 52 is driven at the predetermined rotary speed by a control signal outputted from the ECU 100 (step S2). The ECU 100 maintains the control valve 26 in the closed state. Next, the switch valve 90 switches so as to connect the purge passage 22*a* and the air introducing pipe 92 by a control signal from the ECU 100 (step S4). Due to this, open air is introduced to the purge passage 22*a*. The air introduced to the purge passage 22*a* passes through the branch passages 56, 58. That is, by driving the pump 52, the air circulates in the purge passage 22*a* and the branch passage 22*b*. At this occasion, the concentration sensor 57 detects a pressure difference P0 between the upstream and downstream sides of the sensor (step S6). After the detection of the pressure difference P0 is completed, the switch valve 90 switches so as to connect the purge passage 22*a* and the canister 19 by a control signal from the ECU 100 (step S8). Due to this, the purge gas is introduced to the purge passage 22*a*. That is, the purge gas circulates in the purge passage 22*a* and the branch passage 22*b*. The concentration sensor 57 detects a pressure difference P1 between the upstream and downstream sides of the sensor (step S10). After the detection of the pressure difference P1, the concentration and the flow rate of the purge gas are calculated (step S12), and the pump 52 is stopped (step S14).

Figure 14:
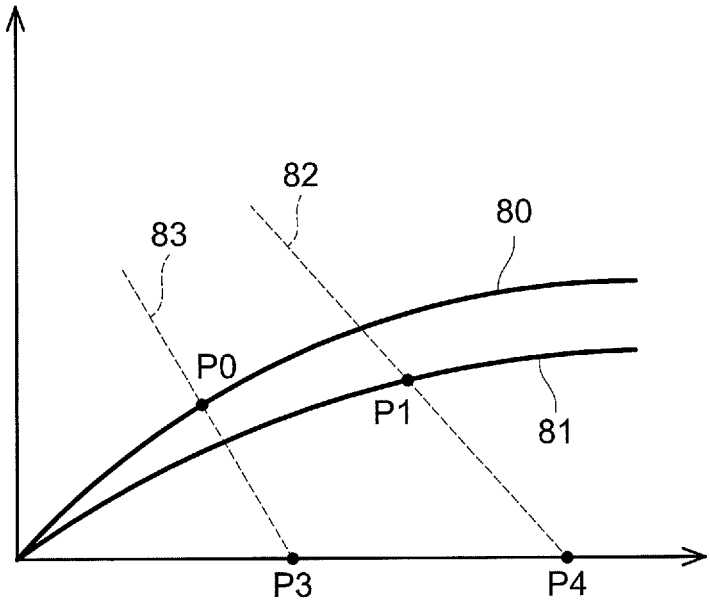
FIG. 14 shows a relationship between a differential pressure in a concentration sensor and a flow rate of a pump.

FIG. 14 shows a characteristic of the concentration sensor 57 (characteristic based on the pressure difference caused by a structure of the concentration sensor) and the flow rate characteristic of the pump 52. A horizontal axis indicates pressure, and a vertical axis indicates the flow rate of the gas passing through the pump 52. A curve 80 indicates the characteristic of the concentration sensor 57 when the open air is introduced to the purge passage 22*a*, a curve 81 indicates the characteristic of the concentration sensor 57 when the purge gas is introduced to the purge passage 22*a*, a straight line 82 indicates the flow rate characteristic of the pump 52 when the purge gas is introduced to the purge passage 22*a*, and a straight line 83 indicates the flow rate characteristic of the pump 52 when the open air is introduced to the purge passage 22*a*.

As is apparent from the pressure differences P0, P1, when the pump 52 is driven at the same rotary speed, the pressure difference increases in the case where the purge gas is being introduced to the purge passage 22*a* than in the case where the open air is being introduced thereto. This result is brought because the purge gas has a higher density than the open air. Due to this, there is a case where a desired quantity of the purge gas cannot be introduced to the intake pipe 34 merely by adjustment of the output (rotary speed) of the pump 52.

The purge gas is not contained in the open air. That is, the density of the open air is known. Due to this, by detecting the pressure differences P0, P1, the concentration of the purge gas can be detected. For example, the purge gas concentration can be calculated by calculating "P1÷P0". Further, as described above, the flow rate can be calculated from the Bernoulli equation. Due to this, the flow rate of the gas (the purge gas, the air) passing through the concentration sensor 57 can be accurately calculated from the concentrations of the gas, and the curves 80, 81 each can be created. Further, the flow rate characteristic of the pump 52 can be obtained by comparing the flow rate of the purge gas with the flow rate of the air (the curves 80, 81) upon when the pump 52 is driven at the predetermined rotary speed, and the purge gas supply quantity during purging can more accurately be adjusted. The above method can similarly perform the calculation by measuring the pressure on the upstream side of the sensor by using the pressure gauge 71 (see FIGS. 8 to 11) without depending on the pressure differences P0, P1 between the upstream and downstream sides of the sensor. By performing the above method (steps S2 to S14), the flow rate characteristic of the pump 52 can be obtained and the detection accuracy of the purge gas concentration can be improved. Due to this, the steps of introducing the open air to the purge passage 22*a* and measuring the pressure difference P0 between the upstream and downstream sides of the sensor (steps S4 to S8) may be omitted as needed. The purge gas concentration can be detected even if steps S4 to S8 are omitted.

Figure 15:
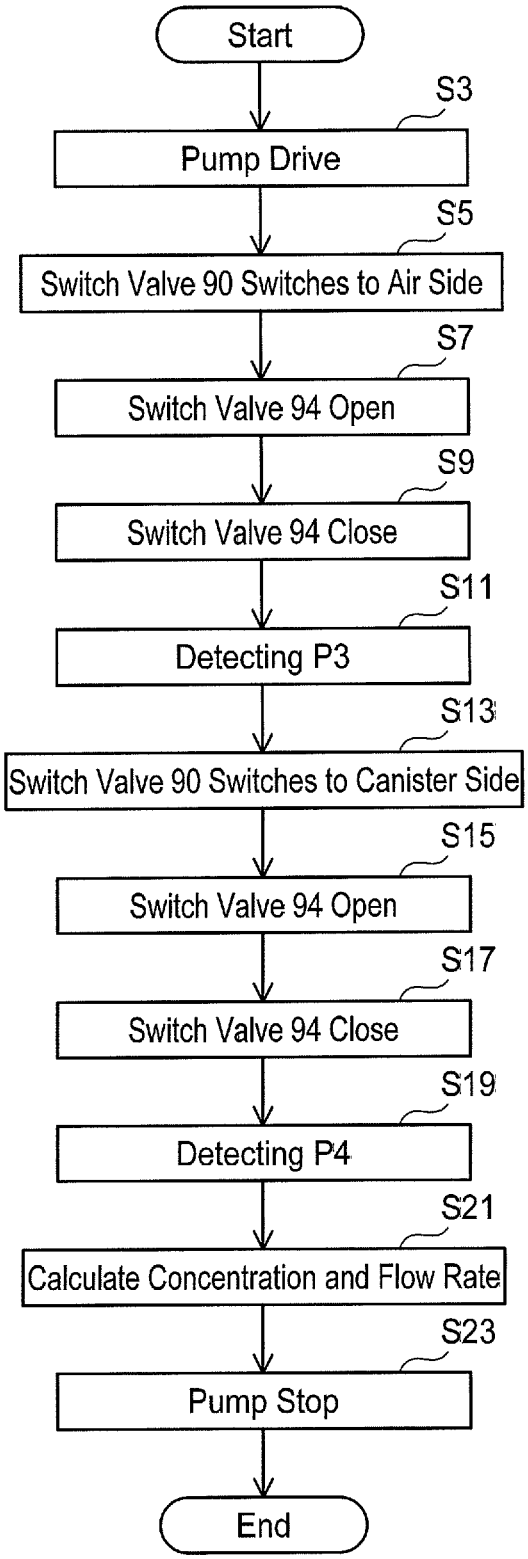
FIG. 15 shows a flowchart of a method of adjusting a purge gas supply quantity.
Figure 16:
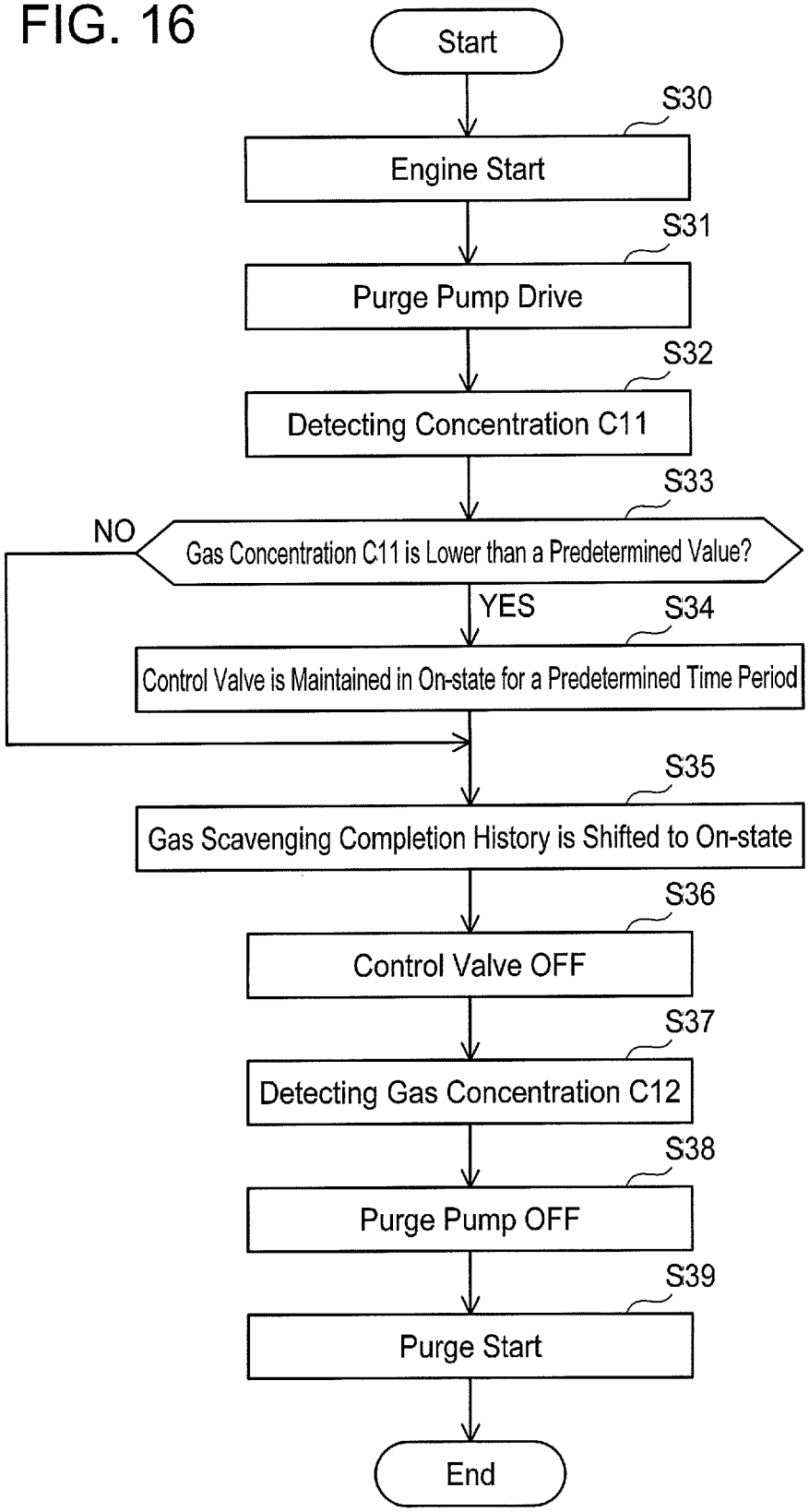
FIG. 16 shows a flowchart of the method of adjusting the purge gas supply quantity.

Further, the purge gas concentration and the purge gas flow rate may be detected by using the evaporated fuel processing device 20*d* provided with the switch valve 94 (see FIG. 10) according to a flow shown in FIG. 15. Firstly, the pump 52 is driven at the predetermined rotary speed by a control signal outputted from the ECU 100 (step S3). The ECU 100 maintains the control valve 26 in the closed state. Next, the switch valve 90 switches so as to connect the purge passage 22*a* and the air introducing pipe 92 by a control signal from the ECU 100 (step S5). Next, the switch valve 94 switches so as to connect the branch passage 22*b* and the communication pipe 18 by a control signal from the ECU 100 (step S7). Due to this, inside of the branch passage 22*b* is replaced with the air. After this, the switch valve 94 is closed to cut off communication between the branch passage 22*b* and the communication pipe 18 (step S9) and a pressure P3 on the upstream side of the concentration sensor 57 is measured by the pressure gauge 71 (step S11). After the detection of the pressure P3 is completed, the switch valve 90 switches so as to connect the purge passage 22*a* and the canister 19 by a control signal from the ECU 100 (step S13). The purge gas is introduced to the purge passage 22*a*. After this, the switch valve 94 switches so as to connect the branch passage 22*b* and the communication pipe 18 (step S15), and the inside of the branch passage 22*b* is replaced with the purge gas. After this, the switch valve 94 is closed (step S17) and a pressure P4 on the upstream side of the concentration sensor 57 is measured by the pressure gauge 71 (step S19).

After the detection of the pressure P4, the concentration and the flow rate of the purge gas are calculated (step S21), and the pump 52 is stopped (step S23). The pressures P3 and P4 are measured in a state where no gas is passing through (flowing in) the branch passage 22*b* (also see FIG. 14). Since the density of the open air is known, the purge gas concentration can be calculated from "P4÷P3". Further, the flow rate characteristic of the pump 52 (the straight line 82) upon when the purge gas is introduced to the purge passage 22*a* can be obtained from the pressure P1 and the pressure P4. Further, the flow rate characteristic of the pump 52 (the straight line 83) upon when the air is introduced to the purge passage 22*a* can be obtained from the pressure P0 and the pressure P3.

Figure 17:
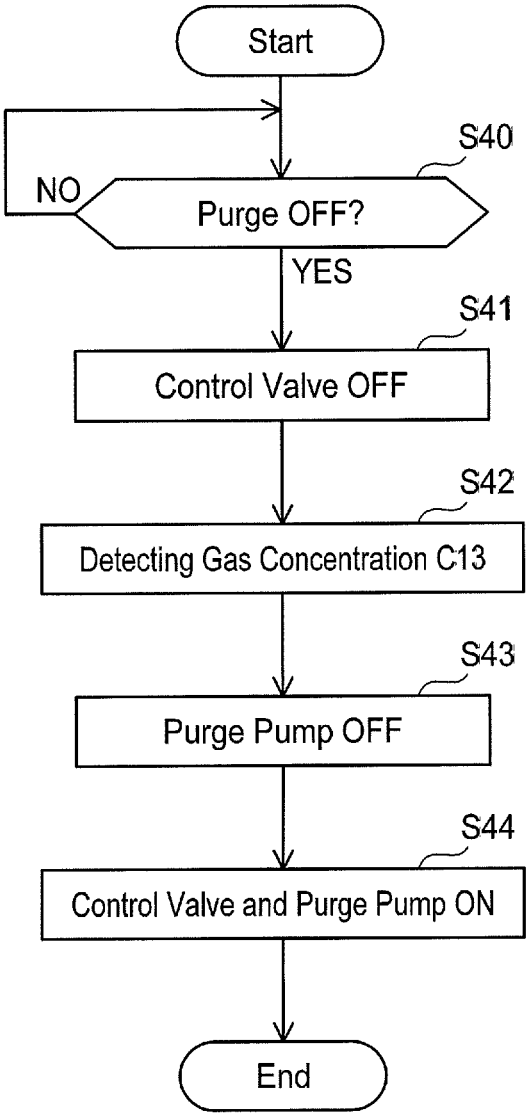
FIG. 17 shows a flowchart of the method of adjusting the purge gas supply quantity.
Figure 18:
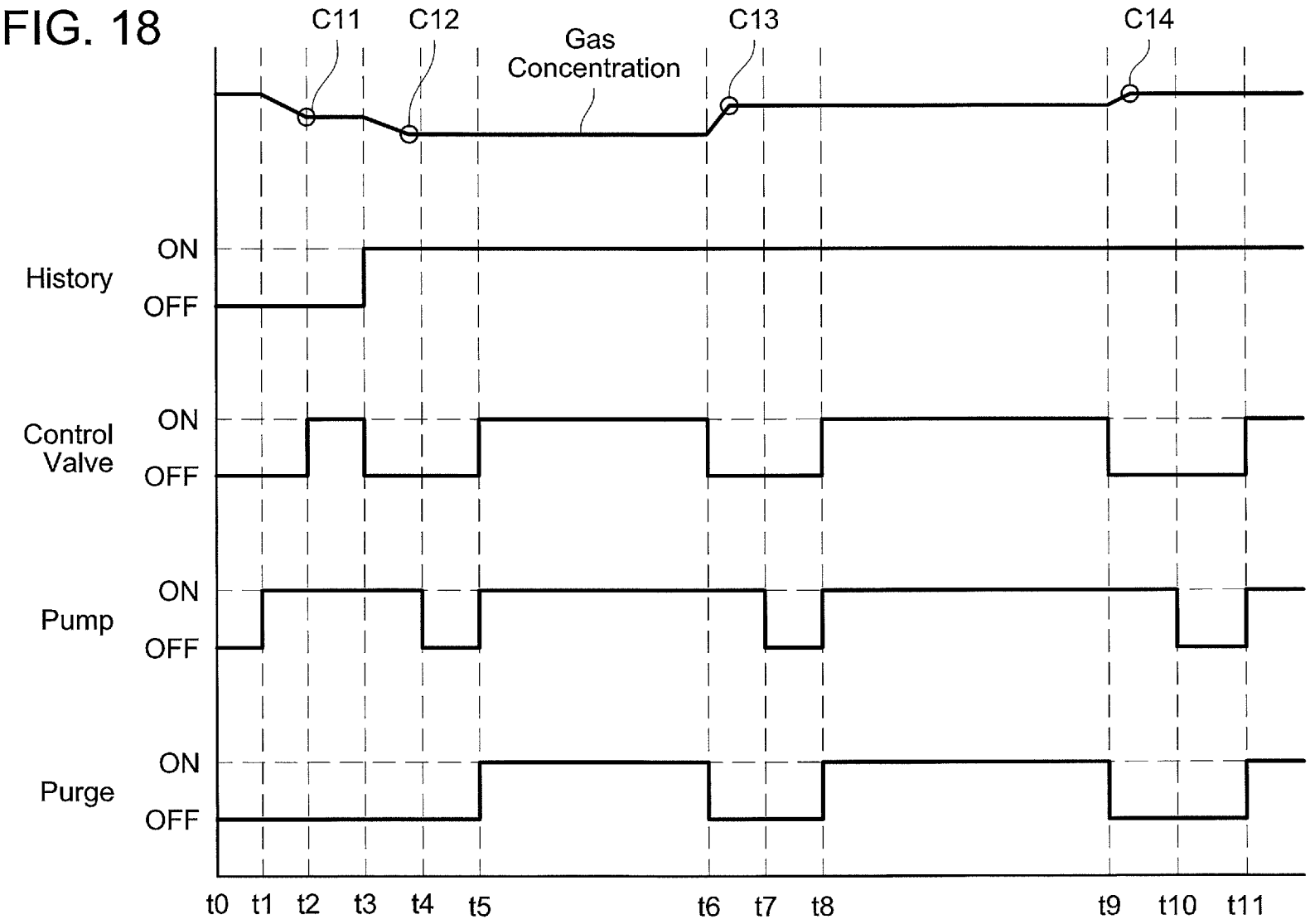
FIG. 18 shows a timing chart of the purge gas supply quantity adjusting process.
Figure 19:
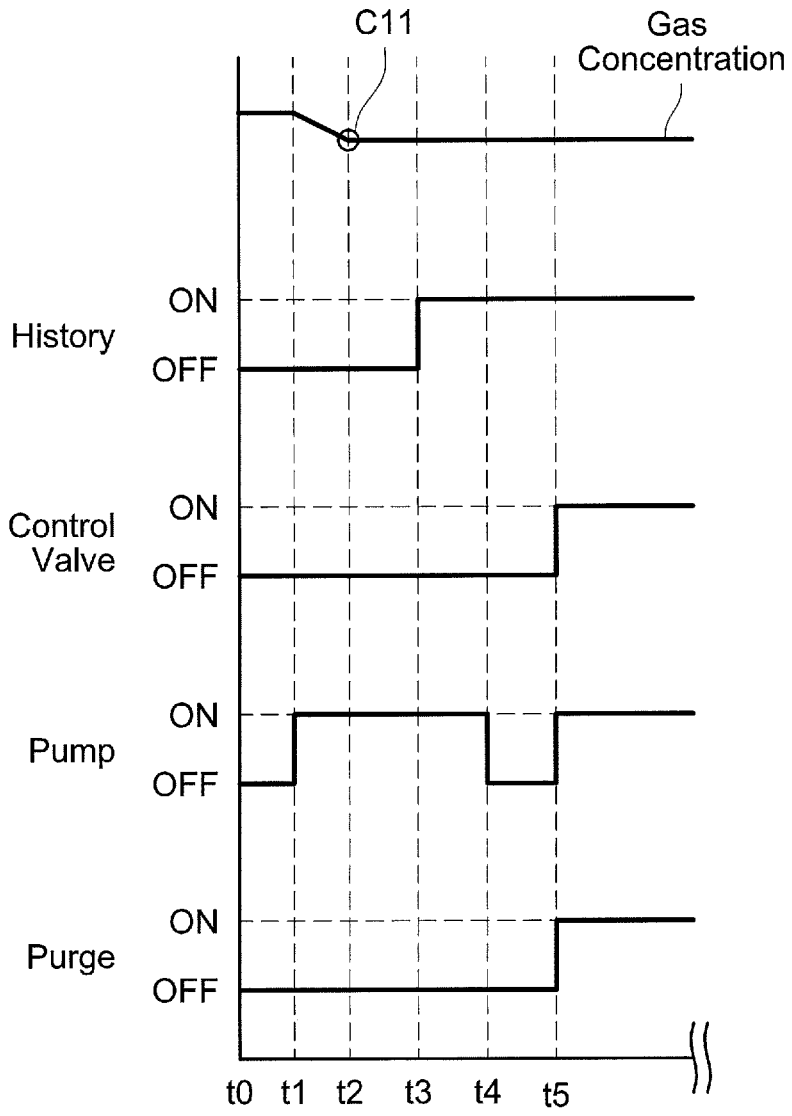
FIG. 19 shows a timing chart of the purge gas supply quantity adjusting process.

With reference to FIGS. 16 to 19, a method of adjusting the purge gas supply quantity when the purge gas concentration changes during a purge will be described. This method may be performed in any of the evaporated fuel processing devices 20, 20*a* to 20*e*. Further, the concentration sensor may be any one of the concentration sensors 57*a*, 57*b*, 57*c*, and 57*d*. In this method, gas remaining in the purge passage (the purge gas that remained upon when a previous purge was completed) is scavenged (that is, discharged to the intake pipe 34) prior to executing a purge to the intake pipe 34. When the gas remaining in the purge passage is scavenged, the evaporated fuel adsorbed in the canister 19 is introduced to the purge passage. FIGS. 18 and 19 are timing charts showing timings to execute a purge, and on/off states of the pump 52 and the control valve 26. The on/off states of the pump 52 and the control valve 26 are controlled by control signals from the ECU 100.

A timing t0 indicates a timing when the vehicle entered the state in which it is capable of traveling. For example, the time when the engine 2 starts corresponds to the timing t0. At the timing t0, gas is stagnating in the purge passage, and the ECU 100 stores that the gas in the purge passage has not been scavenged. At the timing t0, the ECU 100 stores that a gas scavenging completion history is in an OFF state. At the timing t0, the pump 52 and the control valve 26 are in the off states. After the engine 2 is started (step S30), the pump 52 is driven with the control valve 26 in the off state (step S31: timing t1). A purge gas concentration is measured between the timing t1 and a timing t2 while the control valve 26 is off (step S32). The aforementioned method may be used as the method of measuring the purge gas concentration.

In a case where a purge gas concentration C11 detected in step S32 is lower than a predetermined value (step S33: YES), the process proceeds to step S34, and the control valve 26 is turned on and maintained in the on state for a predetermined time period with the pump 52 in the on state (timings t2 to t3). Due to this, the gas that was stagnating in the purge passage (the purge gas that remained from when the previous purge process was completed) can be scavenged from the purge passage. A time period during which the control valve 26 is maintained in the on state (timings t2 to t3) is determined based on the purge gas concentration C11 detected during a time period between the timings t1 and t2. Due to this, an A/F can be suppressed from being deviated greatly by the purge gas scavenged to the intake passage 34.

When the scavenging of the remaining gas is completed, the gas scavenging completion history is shifted to an ON state (step S35, timing t3). The gas scavenging completion history is maintained in the ON state while the engine 2 is driving. Further, after the scavenging of the remaining gas is completed, the control valve 26 is turned off with the pump 52 being driven (step S36, timing t3). After this, a purge gas concentration C12 in the purge passage is detected (step S37). After the detection of the purge gas concentration C12, the pump 52 is turned off (step S38, timing t4). A value of the purge gas concentration C12 detected between the timings t3 and t4 is used when the ECU 100 outputs a purge-ON signal (when a purge is actually started: step S39, timing t5). That is, upon starting a purge, the aperture of the control valve 26 and the output of the pump 52 are determined based on the value of the gas concentration C12.

In a case where the concentration C11 of the purge gas in the purge passage is higher than the predetermined value in step S33 (step S33: NO), the control valve 26 is not turned on at the timing t2 as shown in FIG. 19. Further, although the scavenging in the purge passage is actually not finished yet, the process proceeds to step S35 and the gas scavenging completion history is set to the ON state. In this case, upon when a purge is actually started (timing t5), the aperture of the control valve 26 and the output of the pump 52 are determined based on the value of the gas concentration C11. In a case where the gas concentration in the purge passage (concentration of the remaining gas) is high, the A/F tends to become rich when this gas is scavenged to the intake pipe 34. When this occurs, nitrogen oxides tend to be generated in exhaust gas. Due to this, in the case where the concentration of the remaining gas in the purge passage is higher than the predetermined value, the scavenging of the purge passage is not performed, and the aperture of the control valve 26 and the output of the pump 52 are determined based on the gas concentration C11.

FIG. 17 shows the method of adjusting the purge gas supply quantity from the timing t5 in FIG. 18 and thereafter. When a purge is started at the timing t5, the pump 52 is driven, the control valve 26 is turned on, and the purge gas is supplied to the intake pipe 34 during a time period from the timing t5 to a timing t6. In step S40, a determination is made on whether or not a purge-OFF signal is outputted at the timing t5 or thereafter. In a case where the purge-OFF signal is outputted (step S40: YES), the control valve 26 is turned off (step S41, timing t6). At the timing t6, the pump 52 is maintained to be driven (timings t6 to t7). A gas concentration C13 in the purge passage is detected during a time period from the timing t6 to a timing t7 (step S42). After the detection of the gas concentration C13, the pump is turned off (step S43, timing t7). After this, when the purge-ON signal is outputted (timing t8), the control valve 26 is turned on and the pump 52 is turned on (step S44).

During a time period from the timing t8 to a timing t9, the aperture of the control valve. 26 and the output of the pump 52 are determined based on the gas concentration C13. In timings t9 to t11, the same operations as those in the timings t6 to t8 are performed. That is, the pump 52 is driven for the predetermined time period (t9 to t10) while the purge is the OFF state (t9 to t11), and a gas concentration C14 is detected.

In the above method, the purge gas concentration is detected while the purge is in the OFF state (the control valve is closed), and the aperture of the control valve 26 and the output of the pump 52 during the purge being the ON state are controlled based on this gas concentration. Since the purge gas concentration is known upon when the purge is started, the purge gas supply quantity can be adjusted more accurately. Further, since the purge passage is scavenged during the time period between the start of the engine 2 and the start of the purge, the concentration of the purge gas supplied from the canister 19 can effectively be reflected in the purge supply quantity when the purge is started. Further, upon when the purge passage is scavenged, the concentration of the purge gas remaining in the purge passage is detected before the scavenging, so the A/F can be prevented from being deviated greatly upon the scavenging.

Figure 23:
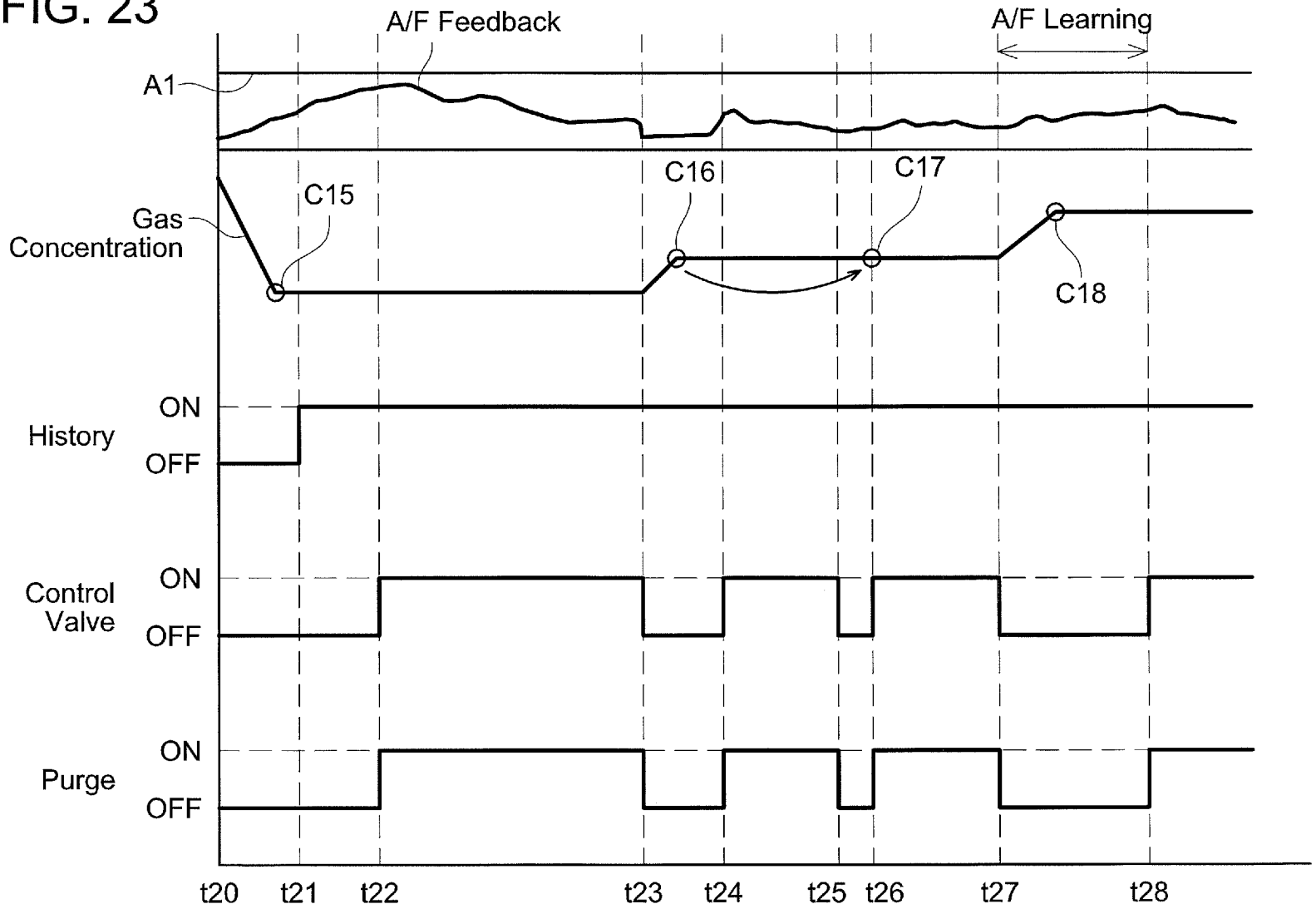
FIG. 23 shows a timing chart of the purge gas supply quantity adjusting process.
Figure 24:
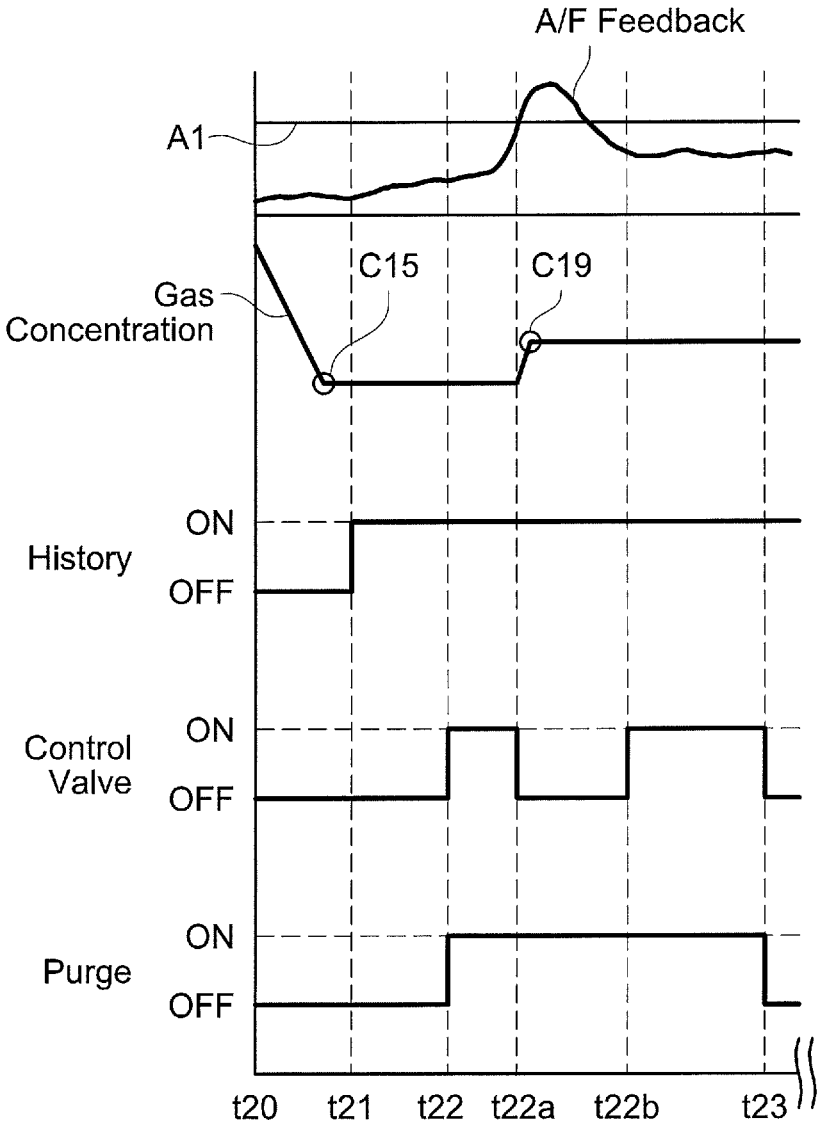
FIG. 24 shows a timing chart of the purge gas supply quantity adjusting process.

Another method of adjusting the purge gas supply quantity when the purge gas concentration changes during a purge will be described with reference to FIGS. 20 to 24. This method may be performed in any of the evaporated fuel processing devices 20, 20*a* to 20*e*. Further, the concentration sensor may be any one of the concentration sensor 57*a*, 57*b*, 57*c*, and 57*d*. In this method, the purge gas is supplied to the intake pipe 34 while the purge gas concertation is corrected based on a temperature change in the engine 2. FIGS. 23 and 24 are timing charts showing timings to perform a purge and the on/off states of the control valve 26. The on/off states of the control valve 26 are controlled by a control signal from the ECU 100.

Typically, after the engine has been started, a temperature of the engine rises. When the temperature of the engine rises, a temperature in the purge passage rises accordingly, and the purge gas concentration in the purge passage thereby changes. By detecting the purge gas concentration based on the temperature change in the engine, the purge gas concentration can be detected accurately, and the A/F can be prevented from being greatly deviated. As the engine is driven, an engine water temperature (temperature of cooling water in the engine) rises. In this method, the method of detecting the purge gas concentration is changed depending on whether or not the engine water temperature exceeds a predetermined value.

Figure 20:
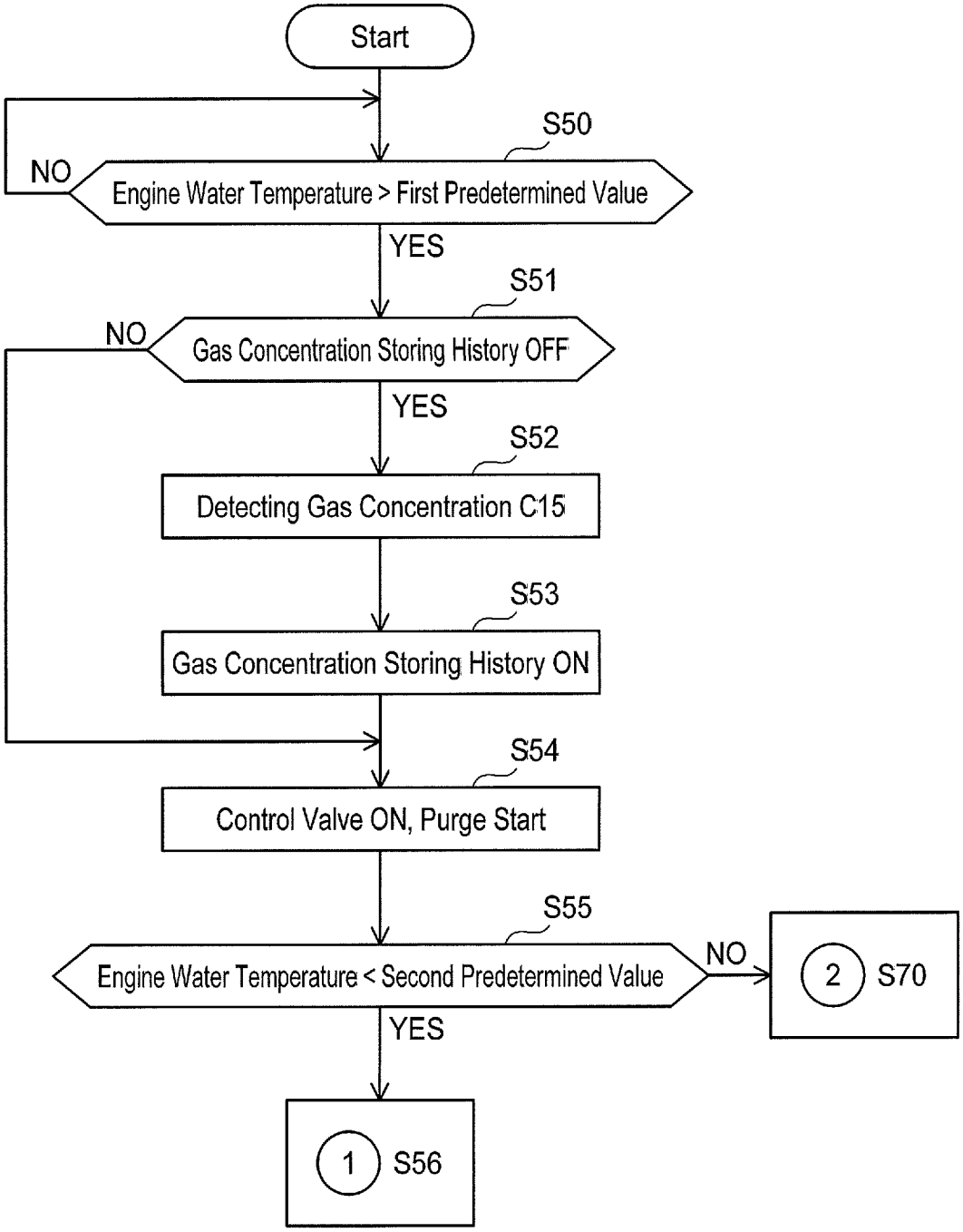
FIG. 20 shows a flowchart of a purge gas supply quantity adjusting process.

In step S50 of FIG. 20, a determination is made on whether or not the engine water temperature exceeded a first predetermined value (for example, 15° C.). In a case where the engine water temperature does not exceed the first predetermined value (step S50: NO), the engine water temperature is repeatedly measured until the engine water temperature exceeds the first predetermined value. When the engine water temperature has exceeded the first predetermined value (step S50: YES), in a case where a gas concentration history for the purge gas is not stored in the ECU 100 (step S51: YES), the purge gas concentration is started to be measured with the control valve 26 closed (step S52, timings t20 to t21). The measurement of the purge gas concentration with the control valve 26 in the closed state may be performed by the aforementioned method. A gas concentration C15 upon when the purge gas concentration has stabilized is stored in the ECU 100 as the gas concentration history, and a gas concentration storing history is set to an ON state (step S53, timing t21).

After the gas concentration storing history has been set to the ON state, the control valve 26 is turned on and a purge is started (step S54, timing t22). Upon when the purge is started, the aperture (or the duty ratio) of the control valve 26 and the flow rate (output) of the pump 52 are determined based on the gas concentration C15. In a case where the gas concentration of the purge gas is stored in the ECU 100 (step S51: NO), the purge is started based on the stored gas concentration. That is, in the case where the gas concentration is not stored (the gas concentration storing history is OFF), the gas concentration is measured without starting a purge (the first purge after the engine has been started), and then the purge is started. During the purge, whether the engine water temperature is less than a second predetermined value (for example, 60° C.) (step S55: YES) or the engine water temperature is equal to or greater than the second predetermined value (step S55: NO) is measured. In this method, a method of correcting the purge gas concentration differs depending on whether the engine water temperature is less than the second predetermined value or not. In a case where the engine water temperature is less than the second predetermined value, the process proceeds to step S56 of FIG. 21. In a case where the purge is set to the ON state (the control valve 26 is in the on state) in step S56 (step S56: YES), and in a case where a feedback deviation amount from an A/F sensor is equal to or less than a predetermined value A1 (step S57: NO), the purge is continued (step S58). A case where the feedback deviation amount from the A/F sensor is greater than the predetermined value A1 (step S57: YES) will be described later. The feedback deviation amount from the A/F sensor may be used to correct the purge gas concentration stored in the ECU 100 based on the feedback deviation amount without stopping the purge (while continuing the purge). By correcting the gas concentration, the purge gas supply quantity can be adjusted more accurately.

In a case where the purge is set to the OFF state in step S56 (timing t23, step S56: NO), the process proceeds to step S59, and it is determined whether or not a purge OFF period (a period between timings t23 and t24) is longer than a predetermined time T1. In a case where the period between t23 and t24 is longer than the predetermined time T1 (step S59: YES), the purge gas concentration is measured in the purge OFF state (step S60). A gas concentration C16 upon when the purge gas concentration has stabilized is stored in the ECU 100 (step S61), the process returns to step S54 of FIG. 20 at a timing t24 when the next purge is started, the aperture of the control valve 26 and the flow rate of the pump 52 are controlled based on the concentration C16, and the purge is continued.

In a case where the purge OFF period is shorter than the predetermined time T1 in step S59, such as a period between t25 and t26 (step S59: NO), the purge gas concentration cannot be detected while the purge is the off state. In this case, the gas concentration C16 stored in the ECU 100 when the purge was set to the off state (the gas concentration measured when the purge was previously set to the off state) (at the timing t25) is stored as a gas concentration C17 to be used at a timing of the next purge (at the timing t26) (step S62). After this, the process returns to step S54 of FIG. 20, the aperture (duty ratio) of the control valve 26 and the flow rate of the pump 52 are controlled based on the gas concentration C17 (the gas concentration C16), and the purge is continued. The predetermined time T1 is an example of second predetermined time recited in the claims.

Figure 21:
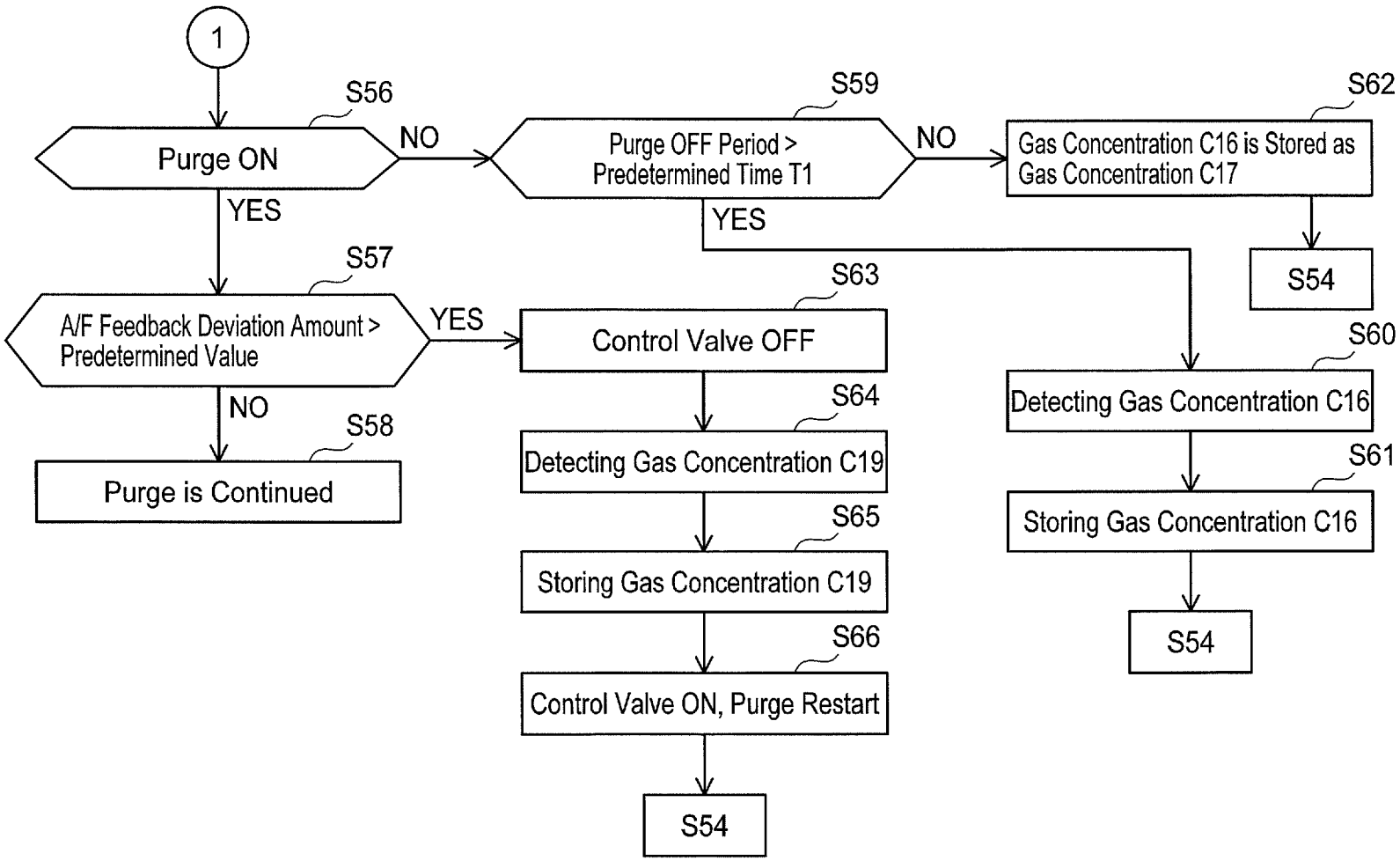
FIG. 21 shows a flowchart of the purge gas supply quantity adjusting process.
Figure 22:
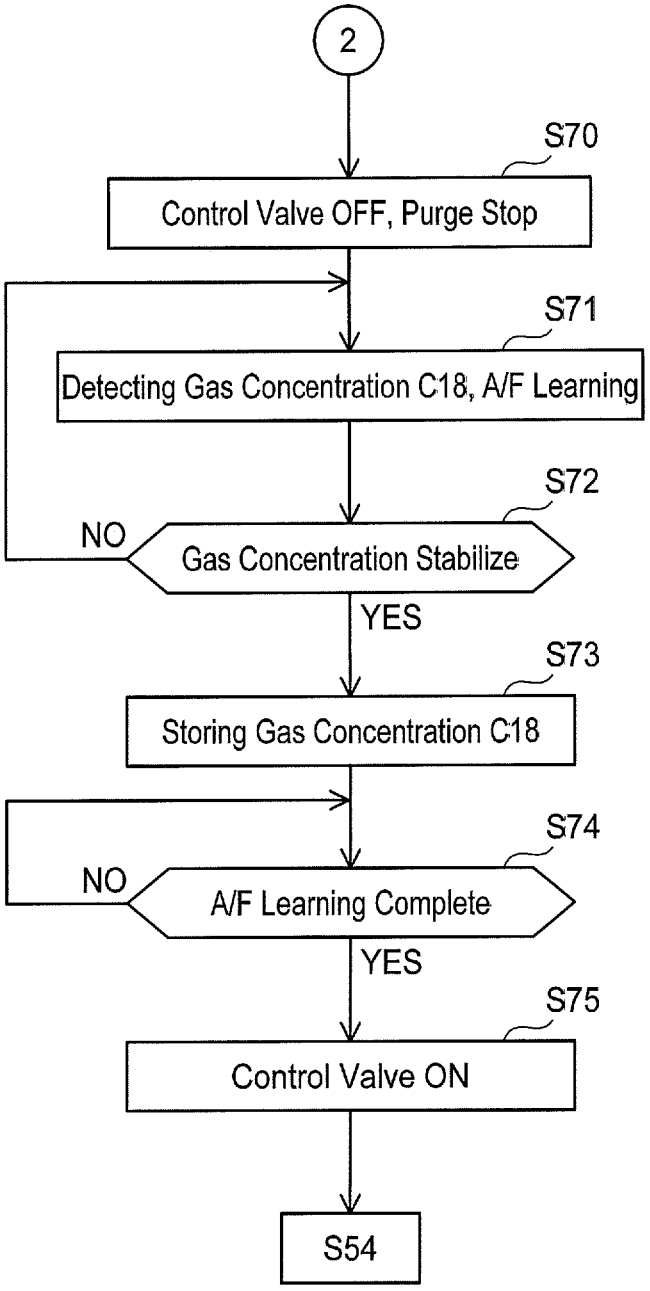
FIG. 22 shows a flowchart of the purge gas supply quantity adjusting process.

Here, the case where the feedback deviation amount from the A/F sensor is greater than the predetermined value A1 in step S57 of FIG. 21 (step S57: YES) will be described with reference to FIG. 24. In this case, even when the purge is in the ON state (timings t22 to t23), the control valve 26 is turned off for a predetermined time period (step S63, timing t22*a*) and a purge gas concentration C19 is measured (step S64). That is, the purge is substantially set to the off state. The gas concentration C19 upon when the purge gas concentration has stabilized is stored in the ECU 100 (step S65), and then the purge is restarted (the control valve is turned on) (step S66, timing t22*b*). The process returns to step S54 of FIG. 20 at the timing t22*b*, the aperture of the control valve 26 and the flow rate of the pump 52 are controlled based on the gas concentration C19, and the purge is continued.

Next, a case where the engine water temperature is equal to or greater than the second predetermined value (step 555: NO) in FIG. 20 will be described with reference to FIGS. 22 and 23. Typically in the vehicle, an A/F learning starts when the engine water temperature becomes equal to or greater than the second predetermined value (for example, 60° C.). When the engine water temperature becomes equal to or greater than the second predetermined value (step S55: NO), the control valve 26 is turned off and the purge is stopped (step S70, timing t27). The purge gas concentration measurement and the A/F learning are started in the state where the purge is stopped (step S71). In a case where the purge gas concentration does not stabilize (step S72: NO), the detection is continued until the purge gas concentration stabilizes. After the purge gas concentration has stabilized (step S72: YES), a detected gas concentration C18 is stored in the ECU 100 (step S73). After this, a determination is made on whether or not the A/F learning is completed (step S74). In a case where the A/F learning is completed (step S74: YES), the control valve 26 is turned on (step S75, timing t28), the aperture (duty ratio) of the control valve 26 and the flow rate of the pump 52 are controlled based on a concentration that is obtained by correcting the gas concertation C18 by an A/F feedback, and the purge is continued.

Figure 25:
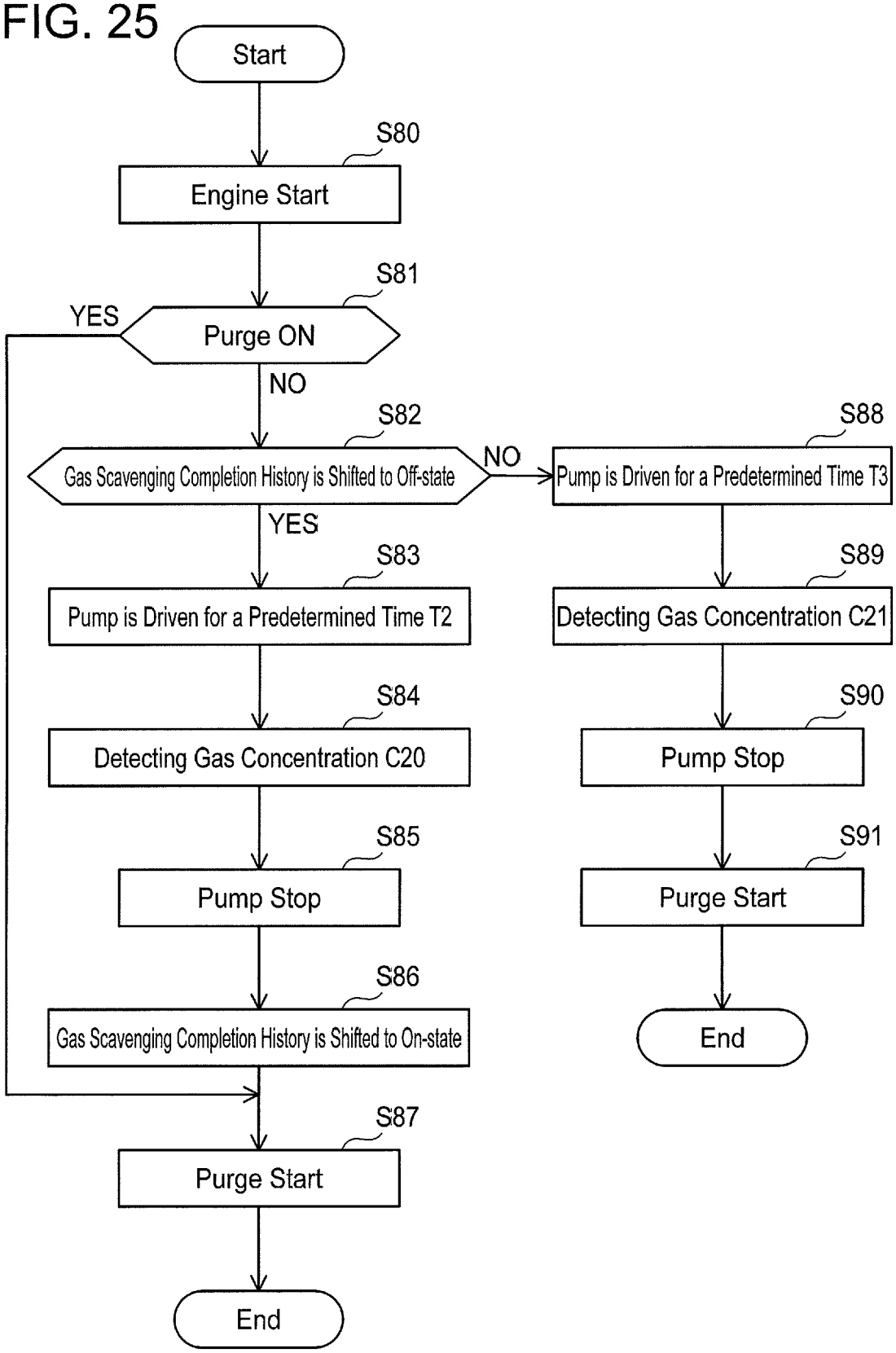
FIG. 25 shows a flowchart of a purge gas supply quantity adjusting process.
Figure 26:
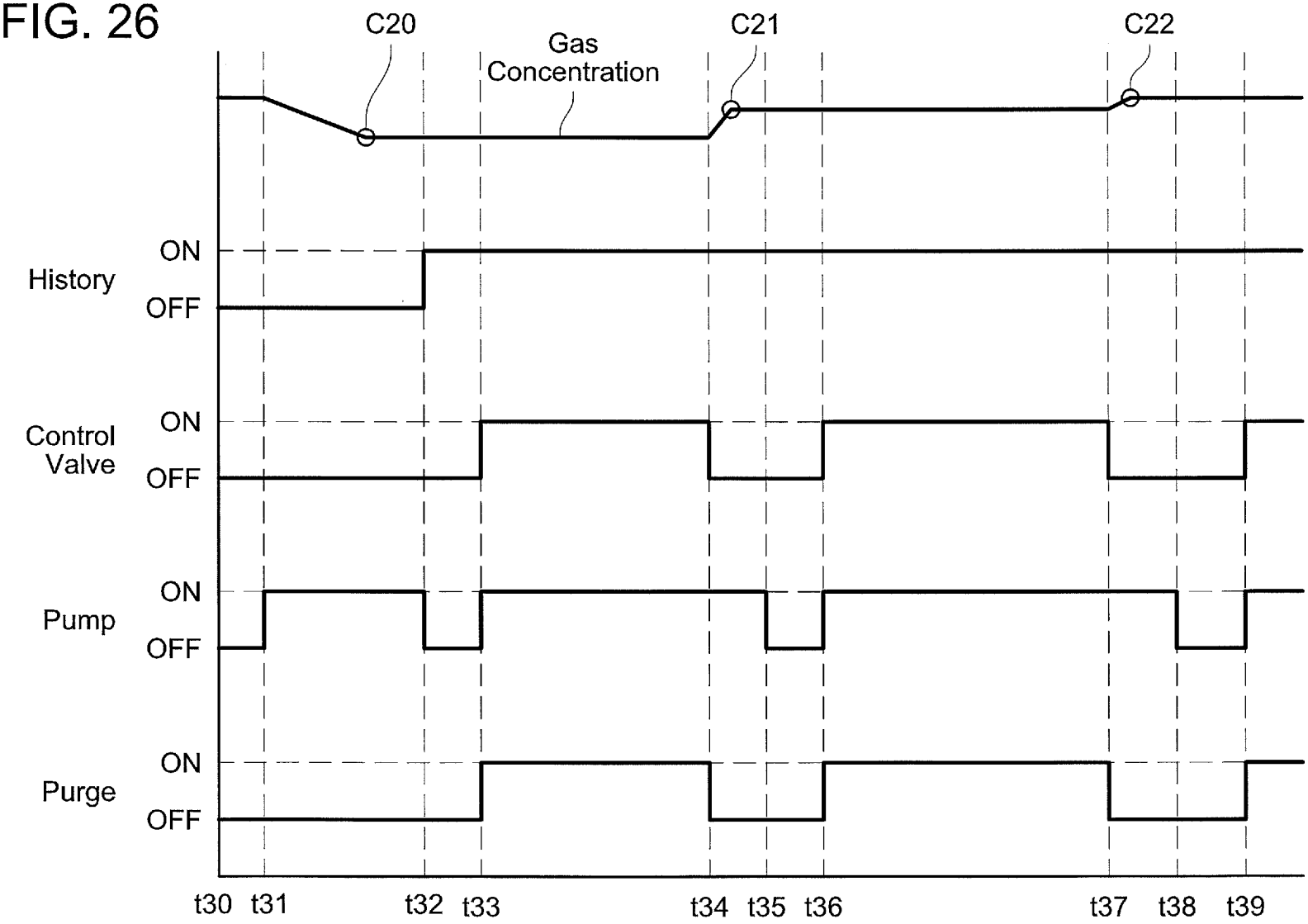
FIG. 26 shows a timing chart of the purge gas supply quantity adjusting process.

A method of determining the purge gas concentration for adjusting the purge gas supply quantity (the aperture of the control valve 26 and the output of the pump 52) during a purge will be described with reference to FIGS. 25 and 26. This method may be performed by using an evaporated fuel processing device in which one end of the branch passage 22*b* is connected to the canister 19 (the communication pipe 18), as in the evaporated fuel processing devices 20*c*, 20*d*, and 20*e*. The concentration sensor may be any one of the concentration sensors 57*a*, 57*b*, 57*c*, and 57*d*. In this method, the gas remaining in the purge passage prior to executing the purge to the intake pipe 34 (the purge gas that remained upon when the previous purge was completed) is scavenged to the canister 19. FIG. 26 is a timing chart showing the timings to execute a purge and the on/off states of the pump 52 and the control valve 26. The on/off states of the pump 52 and the control valve 26 are controlled by control signals from the ECU 100.

A timing t30 indicates the timing when the vehicle entered the state in which it is capable of traveling. For example, the time when the engine 2 starts corresponds to the timing t30. At the timing t30, gas is stagnating in the purge passage, and the ECU 100 stores that the gas in the purge passage has not been scavenged. At the timing t30, the ECU 100 stores that the gas scavenging completion history is in the OFF state. Further, at the timing t30, the pump 52 and the control valve 26 are in the off states. After the engine 2 is started (step S80), and when it is confirmed that the purge is in the OFF state (Step S81: NO) and the gas scavenging completion history is in the OFF state (step S82: YES), the pump 52 starts to be driven with the control valve 26 maintained in the off state (timing t31). The pump 52 continues to be driven for a predetermined time T2 (timings t31 to t32) (step S83). The gas in the purge passage is scavenged to the canister 19. The concentration measurement is executed by the concentration sensor while the purge passage is scavenged (step S84). Due to this, a concentration C20 of the purge gas supplied from the canister 19 is acquired.

When the scavenging of the remaining gas is completed by driving the pump 52 for the predetermined time T2, the pump 52 is stopped (step S85), and the gas scavenging completion history is set to the ON state (step S86: timing t32). The gas scavenging completion history is maintained in the ON state while the engine 2 is driving. A value of the gas concentration C20 detected during a time period between the timing t31 and the timing t32 is used when the ECU 100 outputs the purge-ON signal (when a purge is actually started: step S87, timing t33). That is, upon starting the purge, the aperture of the control valve 26 and the output of the pump 52 are determined based on the value of the gas concentration C20.

When the gas scavenging completion history is confirmed to be in the ON state in step 82 (step 82: NO), the pump 52 starts to be driven while the control valve 26 is maintained in the off state (step S88: timing t34). In FIG. 26, since the pump 52 is driving when the timing t34 is reached, so the pump 52 is maintained to be driving. A gas concentration C21 is measured while the pump 52 is driving for a predetermined time T3 (timings t34 to t35) (step S89). After this, the pump 52 is stopped (step S90: timing t35). After this, when the purge ON signal is outputted, the control valve 26 is turned on and the pump 52 is turned on (step S91: timing t36). In general, a time period required for scavenging inside the purge passage is different from a time period required for measuring the gas concentration in the purge passage after the inside of the purge passage has been scavenged. Due to this, there is a case where a required driving duration of the pump 52 is different for the predetermined time T2 and for the predetermined time T3. After the inside of the purge passage has been scavenged, a variation in the gas concentration is smaller as compared to when the inside of the purge passage is being scavenged. Due to this, typically, the ECU 100 controls the driving duration of the pump 52 so that the predetermined time T3 becomes shorter than the predetermined time T2, and controls the measurement of the concentration C21 of the purge gas to be executed at an earlier timing than a timing when the concentration C20 is to be measured.

During a time period between the timing t36 and a timing t37, the aperture of the control valve 26 and the output of the pump 52 are determined based on the gas concentration C21. In timings t37 to t39, the same operations as those in the timings t34 to t36 are performed. That is, the pump 52 is driven for the predetermined time period T2 (t37 to t38) with the purge being in the OFF state (t37 to t39), and a gas concentration C22 is detected.

In the above method, the pump 52 is driven in the purge OFF state (the control valve being closed), and the purge gas is introduced to the canister 19 through the branch passage 22*b*. At this occasion, the purge gas concentration is detected, and the aperture of the control valve 26 and the output of the pump 52 for the purge ON are controlled based on this gas concentration. Since the purge gas concentration is known at a time when the purge is started, the purge gas supply quantity can be adjusted more accurately. Further, since the purge passage is scavenged between the start of the engine 2 and the start of the purge, the concentration of the purge gas supplied from the canister 19 can effectively be reflected to the purge supply quantity when the purge is started.

While specific examples of the present invention have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present invention is not limited to the combinations described at the time the claims are filed. Further, the purpose of the examples illustrated by the present description or drawings is to satisfy multiple objectives simultaneously, and satisfying any one of those objectives gives technical utility to the present invention.

The invention claimed is:

1. An evaporated fuel processing device comprising:

a canister configured to adsorb evaporated fuel evaporated in a fuel tank;

a purge passage that is connected between the canister and an intake passage of an engine of a vehicle, and through which purge gas sent from the canister to the engine passes;

a pump provided on the purge passage and configured to send the purge gas from the canister to the intake passage;

a control valve provided on the purge passage between the intake passage and the pump, and configured to switch between a communication state and a cutoff state, the communication state being a state in which the canister and the intake passage communicate with each other via the purge passage, and the cutoff state being a state in which communication between the canister and the intake passage on the purge passage is cut off;

a branch passage including one end connected to the purge passage on a downstream side relative to the pump and other end connected to the purge passage on an upstream side relative to the pump; and a concentration detector provided on the branch passage.

2. An evaporated fuel processing device comprising:

a canister configured to adsorb evaporated fuel evaporated in a fuel tank;

a purge passage that is connected between the canister and an intake passage of an engine of a vehicle, and through which purge gas sent from the canister to the engine passes;

a pump provided on the purge passage and configured to send the purge gas from the canister to the intake passage;

a control valve provided on the purge passage between the intake passage and the pump, and configured to switch between a communication state and a cutoff state, the communication state being a state in which the canister and the intake passage communicate with each other via the purge passage, and the cutoff state being a state in which communication between the canister and the intake passage on the purge passage is cut off;

a branch passage including one end connected to the purge passage on a downstream side relative to the pump and other end connected to a communication pipe connecting the fuel tank and the canister on an upstream side relative to the pump; and a concentration detector provided on the branch passage.

3. An evaporated fuel processing device comprising:

a canister configured to adsorb evaporated fuel evaporated in a fuel tank;

a purge passage that is connected between the canister and an intake passage of an engine of a vehicle, and through which purge gas sent from the canister to the engine passes;

a pump provided on the purge passage and configured to send the purge gas from the canister to the intake passage;

a control valve provided on the purge passage between the intake passage and the pump, and configured to switch between a communication state and a cutoff state, the communication state being a state in which the canister and the intake passage communicate with each other via the purge passage, and the cutoff state being a state in which communication between the canister and the intake passage on the purge passage is cut off;

a branch passage including one end connected to the purge passage on a downstream side relative to the pump and other end connected to the canister on an upstream side relative to the pump; and a concentration detector provided on the branch passage.

4. The evaporated fuel processing device according to claim 2, wherein the branch passage comprises, at the other end thereof, a member that is configured to allow the purge gas to flow from the purge passage to the canister and prohibit the purge gas from flowing from the canister to the purge passage.

5. The evaporated fuel processing device according to claim 1, further comprising a controller configured to control the control valve and the pump, wherein after a startup operation of the vehicle is performed, the controller is configured to set the control valve to the communication state to scavenge the purge passage, set the control valve to the cutoff state and perform control of detecting a concentration of the purge gas after the scavenging.

6. The evaporated fuel processing device according to claim 5, wherein the controller is configured to perform control of executing a first-time detection of the concentration of the purge gas after the startup operation of the vehicle, when a predetermined time has elapsed after the control valve was set to the cutoff state with the pump being driven.

7. The evaporated fuel processing device according to claim 2, further comprising a controller configured to control the control valve and the pump, wherein after a startup operation of the vehicle is performed, the controller is configured to set the control valve to the cutoff state and perform control of detecting a concentration of the purge gas.

8. The evaporated fuel processing device according to claim 7, wherein the controller is configured to perform control of executing a first-time detection of the concentration of the purge gas after the startup operation of the vehicle when the concentration of the purge gas is stabilized.

9. The evaporated fuel processing device according to claim 7, wherein the controller is configured to perform a first-time detection of the concentration of the purge gas after the startup operation of the vehicle when a predetermined time has elapsed after the control valve was set to the cutoff state with the pump being driven.

10. The evaporated fuel processing device according to claim 5, wherein the controller is configured to perform control of detecting the concentration of the purge gas with the control valve being in the cutoff state after the startup operation of the vehicle, and when purging based on the detected concentration has been performed and stopped, the controller is configured to perform control of detecting the concentration of the purge gas again with the control valve being in the cutoff state and the pump being driven.

11. The evaporated fuel processing device according to claim 10, wherein the controller performs a detection of the concentration of the purge gas that is executed when the purging is performed and stopped at an earlier timing from when the control valve is set to the cutoff state, as compared to a first-time detection of the concentration of the purge gas after the startup operation of the vehicle.

12. The evaporated fuel processing device according to claim 5, wherein the controller is configured to maintain the control valve in the cutoff state during when the concentration of the purge gas is being detected.

13. The evaporated fuel processing device according to claim 10, wherein in a case where a time period from when the control valve is set to the cutoff state to stop the purging after the purging has been performed to when the control valve is set to the communication state to perform next purging is shorter than a second predetermined time, the controller is configured to store the concentration of the purge gas before the control valve is set to the cutoff state as the concentration of the purge gas which is detected with the control valve being in the cutoff state.

14. The evaporated fuel processing device according to claim 5, wherein when a feedback deviation amount from an A/F sensor exceeds a predetermined value during the purging, the controller is configured to drive the pump with the control valve being in the cutoff state, and perform control of detecting the concentration of the purge gas again.

15. The evaporated fuel processing device according to claim 1, further comprising a switching device provided on the purge passage, the switching device configured to switch between a first state in which the purge passage communicates with the canister and a second state in which the purge passage communicates with open air.

16. The evaporated fuel processing device according to claim 3, wherein the branch passage comprises, at the other end thereof, a member that is configured to allow the purge gas to flow from the purge passage to the canister and prohibit the purge gas from flowing from the canister to the purge passage.

17. The evaporated fuel processing device according to claim 3, further comprising a controller configured to control the control valve and the pump, wherein after a startup operation of the vehicle is performed, the controller is configured to set the control valve to the cutoff state and perform control of detecting a concentration of the purge gas.

18. The evaporated fuel processing device according to claim 2, further comprising a switching device provided on the purge passage, the switching device configured to switch between a first state in which the purge passage communicates with the canister and a second state in which the purge passage communicates with open air.

19. The evaporated fuel processing device according to claim 3, further comprising a switching device provided on the purge passage, the switching device configured to switch between a first state in which the purge passage communicates with the canister and a second state in which the purge passage communicates with open air.

* * * * *